US009010410B2

(12) United States Patent
Story

(10) Patent No.: US 9,010,410 B2
(45) Date of Patent: Apr. 21, 2015

(54) TOP DRIVE SYSTEMS AND METHODS

(76) Inventor: Max Jerald Story, Magnolia, AR (US)

( * ) Notice: Subject to any disclaimer, the term of this patent is extended or adjusted under 35 U.S.C. 154(b) by 383 days.

(21) Appl. No.: 13/506,688

(22) Filed: May 8, 2012

(65) Prior Publication Data

US 2013/0112395 A1 May 9, 2013

Related U.S. Application Data

(60) Provisional application No. 61/628,890, filed on Nov. 8, 2011.

(51) Int. Cl.
*E21B 3/02* (2006.01)

(52) U.S. Cl.
CPC ..... *E21B 3/02* (2013.01)

(58) Field of Classification Search
CPC ..... E21B 32/02; E21B 19/18; E21B 19/16; E21B 19/20; E21B 19/084; E21B 15/00; E21B 19/00
USPC ..... 166/379, 78.1, 75.11, 77.5, 77.1, 77.51, 166/77.52, 85.1; 175/52, 85, 220, 162; 173/164
See application file for complete search history.

(56) References Cited

U.S. PATENT DOCUMENTS

| | | | | |
|---|---|---|---|---|
| 2,998,084 | A | 8/1961 | Johnson et al. | 175/214 X |
| 3,144,805 | A | 8/1964 | Hasha | 173/164 |
| 3,212,578 | A | 10/1965 | Hasha | 166/49 |
| 3,282,239 | A | 11/1966 | Hasha | 166/77.5 |
| 3,464,507 | A | 9/1969 | Alexander et al. | |
| 3,483,933 | A | 12/1969 | Dyer et al. | 52/125.2 |
| 3,766,991 | A | 10/1973 | Brown | 173/20 |
| 3,835,940 | A | 9/1974 | Winter, Jr. | 175/85 |
| 3,949,684 | A | 11/1974 | West | 175/195 |
| 4,005,851 | A | 2/1977 | Plote | 254/385 |
| 4,421,179 | A | 12/1983 | Boyadjieff | 173/44 |
| 4,437,524 | A | 3/1984 | Boyadjieff et al. | 173/190 |
| 4,449,596 | A | 5/1984 | Boyadjieff | 175/85 |
| 4,458,768 | A | 7/1984 | Boyadjieff | 175/85 |
| 4,529,045 | A | 7/1985 | Boyadjieff et al. | 173/164 |
| 4,593,773 | A | 6/1986 | Skeie | 175/85 |
| 4,605,077 | A | 8/1986 | Boyadjieff | 175/85 |
| 4,625,796 | A | 12/1986 | Boyadjieff | 166/77.52 |
| 4,667,752 | A | 5/1987 | Berry et al. | 175/85 |
| 4,753,300 | A | 6/1988 | Shaw et al. | 173/164 |
| 4,767,100 | A | 8/1988 | Philpot | 254/386 |
| 4,800,968 | A | 1/1989 | Shaw et al. | 175/85 |
| 4,807,890 | A | 2/1989 | Gorman et al. | 277/346 |
| 4,813,493 | A | 3/1989 | Shaw et al. | 173/164 |
| 4,865,135 | A | 9/1989 | Moses | 175/57 |
| 4,872,517 | A | 10/1989 | Shaw et al. | 173/163 |
| 4,875,530 | A | 10/1989 | Frink et al. | 175/27 |

(Continued)

OTHER PUBLICATIONS

TDS—Top Drive System, new drilling technology; Pinka et al; Acta Montanistica Slovaka; pp. 289-295; 1997.

(Continued)

*Primary Examiner* — Yong-Suk (Philip) Ro
(74) *Attorney, Agent, or Firm* — Guy McClung

(57) ABSTRACT

A system for wellbore operations and methods for use, the wellbore having a wellbore support structure, the system including a hoist subsystem for moving tubulars, a drive subsystem for rotating the tubulars, the drive subsystem releasably connected to the hoist subsystem forming a hoist/drive unit, and powered apparatus for moving the hoist/drive unit, or for moving the hoist subsystem separately.

12 Claims, 31 Drawing Sheets

(56) References Cited

U.S. PATENT DOCUMENTS

| | | | | |
|---|---|---|---|---|
| 4,878,546 | A | 11/1989 | Shaw et al. | 173/163 |
| 4,984,641 | A | 1/1991 | Pryor | 175/170 |
| 5,038,871 | A | 8/1991 | Dinsdale | 175/52 |
| 5,107,940 | A | 4/1992 | Berry | 175/85 |
| 5,197,553 | A | 3/1993 | Leturno | 175/57 |
| 5,251,709 | A | 10/1993 | Richardson | 175/220 |
| 5,271,472 | A | 12/1993 | Leturno | 175/107 |
| 5,381,867 | A | 1/1995 | Berry | 175/85 |
| 5,388,651 | A | 2/1995 | Berry | 175/85 |
| 5,433,279 | A | 7/1995 | Tessari et al. | 173/213 |
| 5,472,057 | A | 12/1995 | Winfree | 175/57 |
| 5,501,286 | A | 3/1996 | Berry | 175/52 |
| 5,503,234 | A | 4/1996 | Clanton | 175/52 |
| 5,713,422 | A | 2/1998 | Dhindsa | 175/27 |
| 5,755,296 | A | 5/1998 | Richardson et al. | 175/162 |
| 5,762,148 | A | 6/1998 | Kattentidt et al. | 173/184 |
| 5,921,328 | A | 7/1999 | Babineau et al. | 175/20 |
| 5,921,329 | A | 7/1999 | Armstrong | 175/57 |
| 6,007,105 | A | 12/1999 | Dietle et al. | 285/94 |
| 6,047,781 | A | 4/2000 | Scott et al. | 175/5 |
| 6,056,071 | A | 5/2000 | Scott et al. | 175/5 |
| 6,276,450 | B1 | 8/2001 | Seneviratne | 166/85.1 |
| 6,412,576 | B1 | 7/2002 | Meiners | 175/57 |
| 6,443,241 | B1 | 9/2002 | Juhasz et al. | 175/52 |
| 6,536,520 | B1 | 3/2003 | Snider et al. | 166/78.1 |
| 6,609,565 | B1 | 8/2003 | Andreychuk et al. | 166/77.2 |
| 6,679,333 | B2 | 1/2004 | York et al. | 166/379 |
| 6,705,405 | B1 | 3/2004 | Pietras | 166/380 |
| 6,742,584 | B1 | 6/2004 | Appleton | 166/98 |
| 6,766,860 | B2 | 7/2004 | Archibald et al. | 166/341 |
| 6,832,658 | B2 | 12/2004 | Keast | 175/170 |
| 6,854,533 | B2 | 2/2005 | Galloway et al. | 175/22 |
| 6,857,487 | B2 | 2/2005 | Galloway et al. | 175/171 |
| 6,896,075 | B2 | 5/2005 | Haugen et al. | 175/57 |
| 6,899,186 | B2 | 5/2005 | Galloway et al. | 175/5 |
| 6,901,998 | B1 | 6/2005 | Roodenburg et al. | 166/85.1 |
| 6,913,096 | B1 | 7/2005 | Nielsen et al. | 175/85 |
| 6,920,926 | B2 | 7/2005 | York et al. | 166/77.1 |
| 6,923,254 | B2 | 8/2005 | Morrow et al. | 166/88.4 |
| 6,938,697 | B2 | 9/2005 | Haugen | 166/380 |
| 7,004,259 | B2 | 2/2006 | Pietras | 166/379 |
| 7,147,068 | B2 | 12/2006 | Vail, III | 175/65 |
| 7,172,037 | B2 | 2/2007 | Dashevskiy et al. | 175/25 |
| 7,188,686 | B2 | 3/2007 | Folk et al. | 175/162 |
| 7,222,683 | B2 | 5/2007 | Folk et al. | 175/162 |
| 7,228,913 | B2 | 6/2007 | Folk et al. | 166/380 |
| 7,231,969 | B2 | 6/2007 | Folk et al. | 166/77.51 |
| 7,243,735 | B2 | 7/2007 | Koederitz et al. | 175/40 |
| 7,270,189 | B2 | 9/2007 | Brown et al. | 166/380 |
| 7,320,374 | B2 | 1/2008 | Folk et al. | 175/220 |
| 7,360,603 | B2 | 4/2008 | Springett et al. | 166/380 |
| 7,451,826 | B2 | 11/2008 | Pietras | 166/380 |
| 7,472,762 | B2 | 1/2009 | West et al. | 175/162 |
| 7,493,970 | B1 | 2/2009 | McKnight, Jr. et al. | 175/113 |
| 7,513,312 | B2 | 4/2009 | Carriere et al. | 166/379 |
| 7,584,810 | B1 | 9/2009 | McKnight, Jr. et al. | 175/162 |
| 7,617,866 | B2 | 11/2009 | Pietras | 166/77.51 |
| 7,628,229 | B2 | 12/2009 | Wood et al. | 175/203 |
| 7,882,902 | B2 | 2/2011 | Boutwell, Jr. | 175/40 |
| 7,896,108 | B2 | 3/2011 | Able et al. | 175/173 |
| 7,931,077 | B2 | 4/2011 | Rudshaug et al. | 166/77.52 |
| 7,984,757 | B1 | 7/2011 | Keast et al. | 166/77.1 |
| 8,037,949 | B2 | 10/2011 | Juhasz et al. | 175/52 |
| 8,042,616 | B2 | 10/2011 | Giroux et al. | 166/382 |
| 8,047,283 | B2 | 11/2011 | Jahn et al. | 166/250.01 |
| 8,047,306 | B2 | 11/2011 | Williams et al. | 175/122 |
| 2005/0133259 | A1 | 6/2005 | Koederitz | 175/27 |
| 2008/0059073 | A1 | 3/2008 | Giroux et al. | 702/9 |
| 2008/0093088 | A1 | 4/2008 | Hopwood et al. | 166/379 |
| 2008/0121392 | A1 | 5/2008 | Chitty et al. | 166/250.17 |
| 2009/0101361 | A1 | 4/2009 | Mason et al. | 166/380 |

OTHER PUBLICATIONS

TDX—1000Top Drive; National Oilwell Varco; 2pp.; 2010.
TDX—1250 Top Drive; National Oilwell Varco; 2pp.; 2010.
TDS—12 Top Drive; National Oilwell Varco; 2pp.; 2010.
Top Drives; Foremost; 2pp.; 2009.
Top drives have transformed drilling; now, new design aims to push ultra-deep, ERD Applications; Reid et al' Drilling Contractor; pp. 24, 26, 28, 29; 2008.
Canrig Top Drive Drilling Systems; 12 pp.; 1996.
Tesco Top Drive Drilling Systems; 8 pp.; 1996.

DSSLR
HSSLR
MHR
MH
DSSL
HSSL
MS
MAST
81
DC
82

Fig. 12A
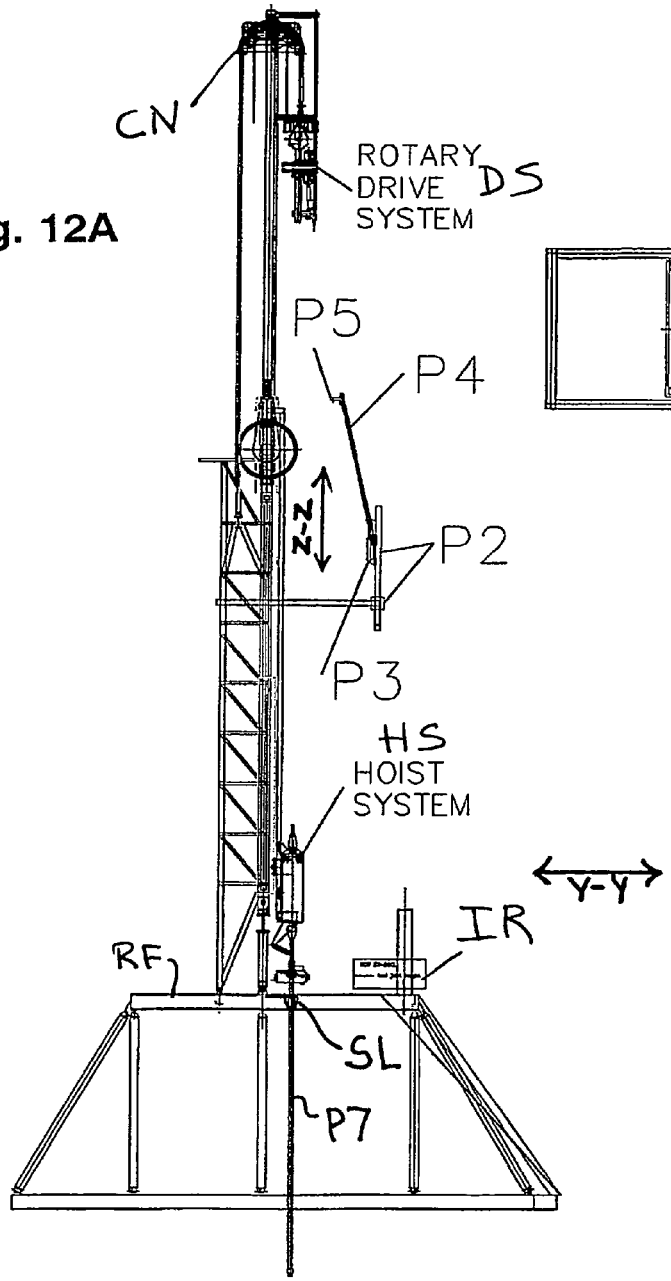
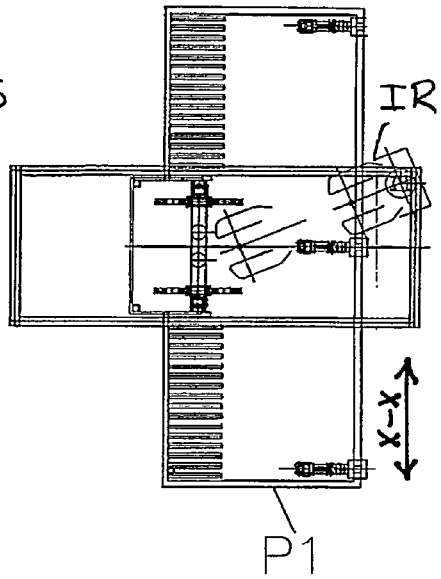
Fig. 12B
1. DOCK ROTARY DRIVE SYSTEM AT CROWN USING WIRE LINES AND SAFETY LOCKING CYLINDERS
2. LOWER HOIST SYSTEM YOKE AROUND STAND IN SLIPS

1. PULL STAND OUT OF HOLE
2. SET SLIPS

Fig. 12D
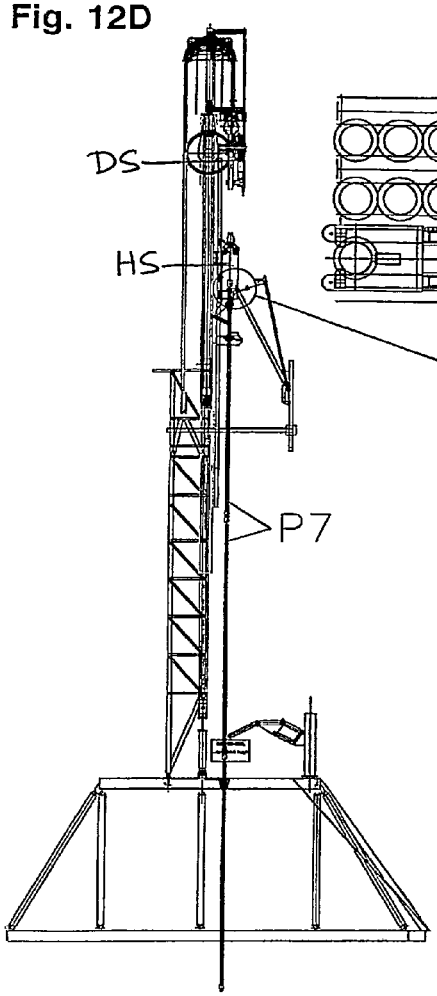
Fig. 12E
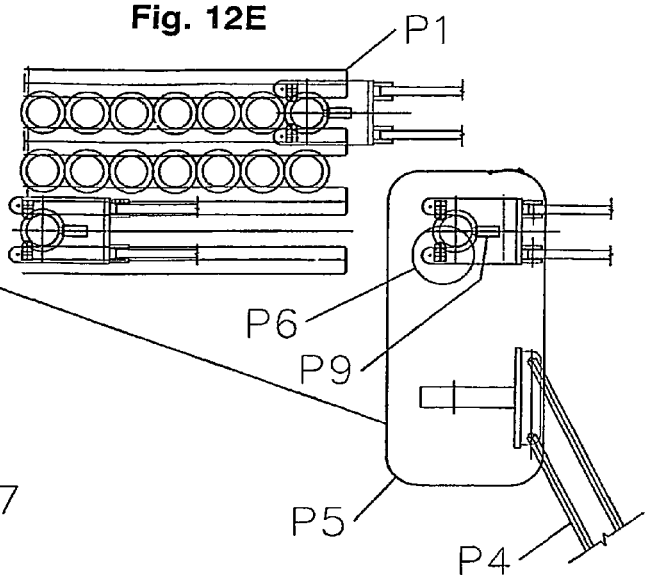
Fig. 12F
1. START LOWERING HOIST SYSTEM, WHEN YOKE IS PAST TRANSFER ELEVATOR POSITION PIPE HANDLER AT TOP OF STAND
2. BO AND SPIN OUT STAND W/IRON ROUGH NECK 1. RELEASE POWERED ELEVATORS WHILE LOWERING HOIST SYSTEM
2. RAISE PIPE HANDLER AND STAND CLEAR OF LOWER TOOL JOINT
3. PIPE HANDLER RACKS STAND 1. WHILE PIPE HANDLER MOVES STAND TO RACKING BOARD, HOIST SYSTEM WITH ELEVATOR MOVES DOWN TO FLOOR AND ATTACHES TO PIPE WITH ELEVATOR
2. THEN STARTS HOISTING WHILE STAND RACKING IS COMPLETED NOTE: SIMULTANEOUS MOVEMENT OF THE HOIST SYSTEM PIPE HANDLER, AND IRON ROUGH NECK IS SAVING TIME.

TOP DRIVE SYSTEMS AND METHODS

RELATED APPLICATION

This application claims priority under the Patent Laws for U.S. Application Ser. No. 61/628,890 filed Nov. 8, 2011, which application is incorporated fully herein for all purposes.

BACKGROUND OF THE INVENTION

1. Field of the Invention

This present invention is directed to: top drives used in wellbore operations which include, but are not limited to, drilling operations and tripping operations; pipe handlers; and service loop assemblies. In certain particular aspects, the present invention is directed to new top drive systems in which, within a derrick, a tubular rotating apparatus is selectively separable from a tubular hoisting apparatus permitting the hoisting apparatus to be used in tubular operations below the rotating apparatus while the tubular rotating apparatus is secured above the tubular hoisting apparatus within the derrick.

2. Description of Related Art

There are a wide variety of known drilling rigs, top drive systems and methods of their use, examples of which are in the exemplary U.S. patents and applications: U.S. Pat. Nos. 7,931,077; 7,882,902; 7,628,229; 7,513,312; 7,472,762; 7,320,374; 7,231,969; 7,228,913; 7,222,683; 7,188,686 6,923,254; 6,705,405; 6,679,333; 6,609,565; 6,536,520; 6,276,450; 6,007,105; 5,921,329; 5,503,234; 5,501,286; 5,433,279; 5,381,867; 5,251,709; 5,038,871; 4,984,641; 4,878,546; 4,872,577; 4,813,493; 4,807,890; 4,800,968; 4,767,100; 4,753,300; 4,458,768; 4,421,179; 4,437,524; 4,005,851; 3,835,940; 3,483,933; and U.S. application Ser. No. 11/823,854 filed Jun. 28, 2007—all of which are incorporated fully herein for all purposes.

It is well known to use a top drive drilling unit to rotate the drill stem of an oil and gas well; see, for example, U.S. Pat. Nos. 4,449,596; 3,464,507; and 3,766,991 and U.S. application Ser. No. 050,537, filed Apr. 20, 1993. In many cases, a top drive drilling unit is suspended by a cable from the crown of a mast of a drilling rig above a drill string. The unit rotates the drill string from the top side as opposed to the use of a rotary table and related equipment at the rig floor. A top drive unit often has a track which runs the length of the mast to guide the top drive, to restrain it from lateral movement and to transfer reactive torque and torsional loads originating from the drilling operation into the derrick substructure. Typical torque drive track systems are disclosed in U.S. Pat. Nos. 4,865,135 5,251,709 and in U.S. patent application Ser. No. 217,689, filed Mar. 24, 1994. In the process of drilling a well, it may be advantageous to disconnect the drill string from the top drive unit and handle sections of drill pipe without the top drive unit in place. In these instances, the top drive unit is disconnected from the draw works and moved away from immediately above the drill string. See, for example, U.S. Pat. Nos. 4,421,179; 4,437,524 and 4,458,768.

U.S. Pat. No. 4,437,524 discloses a well drilling apparatus designed to eliminate the need for a rotary table, kelly and kelly bushing, and includes a drilling unit which is shiftable between a drilling position in vertical alignment with a mousehole, and an inactive position.

U.S. Pat. No. 4,449,596 discloses a top drive well drilling system that includes pipe handling equipment that facilitates the making and breaking of connections to the drill string during the drilling cycle.

U.S. Pat. No. 4,458,768 discloses a top drive well drilling system having a drilling unit shiftable to various positions, wherein the shifting movement is accomplished by means of a structure that guides the unit for movement along predetermined paths.

U.S. Pat. No. 4,605,077 discloses a top drive drilling system having a motor which is connected to the upper end of the drill string and moves upwardly and downwardly therewith.

U.S. Pat. No. 4,625,796 discloses an apparatus comprising a stabbing guide and a back-up tool, wherein the apparatus can function in aligning an additional length of pipe with the upper end of the drill string and thereby facilitates the controlled stabbing of pipe length for addition into the top of a drill string. U.S. Pat. No. 4,667,752 discloses a top head drive well drilling apparatus with a wrench assembly and a stabbing guide, wherein the wrench assembly is mounted on the drive unit and the stabbing guide is mounted on the wrench assembly.

U.S. Pat. No. 5,501,286 discloses and apparatus and method for displacing the lower end of a top drive torque track suspended from a derrick wherein a drive unit is disconnected from the drill string and suspended from the torque track. The top drive suspended from the torque track can then be moved away so as not to interfere with the addition or removal of drill string sections. U.S. Pat. No. 5,755,296 discloses a portable top drive comprising a self-contained assembly of components necessary to quickly install and remove a torque guide and attendant top drive unit in a drilling rig mast.

Conventional service loops hold and house a variety of hoses, conduits, and cables that, among other things transfer electrical, hydraulic and compressed-air power to a top drive. Such service loops are mounted in a drilling derrick and travel up and down under a control of a piece of traveling equipment There are various combinations of hoses, wires and cables that pass through the inside diameters of the service loops. Some top drives utilize a combination of two to four service loops which can have approximately equal length. Each service loop at one end is attached to the derrick (or mast), and at the opposite end is connected to the top drive. As the top drive travels up and down, the service loops move accordingly up and down. In addition, they have a bending movement in the transverse direction, which forms the respective bend radii.

Service loops can vary from about 2 inches to 7 inches in diameter. Variation in paths during operation of the machinery can cause the loops to become entangled. When this happens, loops with the larger diameter can force loops with the smaller diameter into unnatural positions, and this can result in premature failure of the loops with the smaller diameter.

Also, an environmental condition such as a strong wind can be a factor that accelerates failure of the loops. Also, in some cases two or more loops with the smaller diameter can displace a loop with the larger diameter, which can cause problems including broken loops.

BRIEF SUMMARY OF THE INVENTION

The present invention, in certain aspects, discloses systems for wellbore operations which include a drive subsystem and a hoist subsystem. The drive subsystem can, inter alia, be used to rotate tubulars or strings and, in certain aspects, for any of the tasks or functions provided by conventional top drives.

The hoist subsystem can, inter alia, be used to raise and lower tubulars and, in certain aspects, for any tasks or functions provided by elevators, manipulators, grabbers, or handlers positioned below a top drive. Both subsystems are suspended within a rig, mast, or derrick. The drive subsystem is releasably connected to the hoist subsystem and the combined subsystems are movable within the derrick as a unit. Each subsystem is also movable independently within the rig, mast, or derrick when the drive subsystem is disconnected from the hoist subsystem.

In certain aspects, the present invention discloses a system for wellbore operations including: a drive subsystem for rotating tubular releasably connected a hoist subsystem for moving tubulars, the hoist subsystem with the drive subsystem connected thereto movable as a unit within a wellbore support structure or the drive subsystem disconnected from the hoist subsystem so that the hoist subsystem can be used in operations that do not use the drive subsystem, e.g., in one aspect, tripping operations. With such a system, the drive subsystem, when disconnected from the hoist subsystem, can be docked or parked within a derrick, mast, or rig at any desired location, including, but not limited to, near a top thereof.

The present invention discloses methods for using such systems which include: moving a unit within a wellbore support structure (e.g., rig, mast, derrick), the unit having a hoist subsystem for moving tubulars releasably connected to a drive subsystem for rotating tubular; disconnecting the drive subsystem from the hoist subsystem; and moving one or both of the hoist subsystem and the drive subsystem separately within the wellbore structure. In certain aspects, the hoist subsystem is used alone for various operations.

In certain aspects, the present invention provides systems for wellbore operations in which various raising and lowering functions are done with a powered cylinder system according to the present invention without using a typical drawworks.

The present invention, in certain aspects, provides a loop system for the disposition, handling, and guiding of various service loops, including loops, cables, conduits, and hoses used in well operations, e.g., operations associated with a drive system and/or a hoist system. Certain loop systems according to the present invention have rollers that keep each loop separate in an orderly fashion without the need for a drag chain as in many known service loop systems which carry the various loops.

Such a loop system can be used with known rigs and can also be used with systems according to the present invention. In certain loop systems according to the present invention, service loops (e.g., air, hydraulic fluid, drilling mud, electrical cables, etc.) connected to a drive system and hoist system travel up to a crown block area of a mast and wrap around rollers from which they descend to connections in the mast or at the drill floor, e.g., on a side opening of a drive system and/or hoist system.

With such a loop system according to the present invention in certain embodiments, there is no need for the known typical service loop system, e.g., that (on the v-door side of a rig) travels up and down in the rig and down to a rig floor area which can hinder operations.

In certain aspects, the present invention provides a pipe handling system with pipe handling apparatus that can move a stand of pipe to a racking board while a hoist system with an elevator is movable down to a rig floor to attach to a pipe or string in slips. While the stand is being racked, the hoist system begins to hoist the next stand; i.e., the hoist system can move with a new stand simultaneously as the pipe racking apparatus racks a previously disconnected stand; in one aspect, while an iron roughneck is also moving Accordingly, the present invention includes features and advantages which are believed to enable it to advance top drive technology. Characteristics and advantages of the present invention described above and additional features and benefits will be readily apparent to those skilled in the art upon consideration of the following detailed description of preferred embodiments and referring to the accompanying drawings.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful unique, efficient, nonobvious wellbore systems with a drive system releasably connected to a hoist system and methods for their use, the drive system being any known tubular drive system and, in one particular aspect, being a top drive system;

Such systems in which the drive system is selectively releasable from the hoist system and the drive system is securable above the hoist system with the hoist system free to move with respect to the drive system.

New, useful unique, efficient, nonobvious wellbore tubular drive systems and methods for their use;

New, useful unique, efficient, nonobvious wellbore hoist systems and methods for their use;

New, useful unique, efficient, nonobvious wellbore operations service loop systems and methods for their use;

New, useful unique, efficient, nonobvious pipe handler systems and methods for their use;

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention.

Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention and its diverse embodiments recognize and address the long-felt needs and provides a solution to problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

It will be understood that the various embodiments of the present invention may include one, some, or any possible combination of the disclosed, described, and/or enumerated features, aspects, and/or improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification.

These drawings illustrate embodiments preferred at the time of filing for this patent and are not to be used to improperly limit the scope of the invention which may have other equally effective or legally equivalent embodiments. In the appended figures, similar components and/or features may have the same numerical reference label.

Various components of the same type may be distinguished by following the reference label by a letter that distinguishes among the similar components and/or features.

If only the first numerical reference label is used in the specification, the description is applicable to any one of the similar components and/or features having the same first numerical reference label irrespective of the letter suffix.

Figure 1:
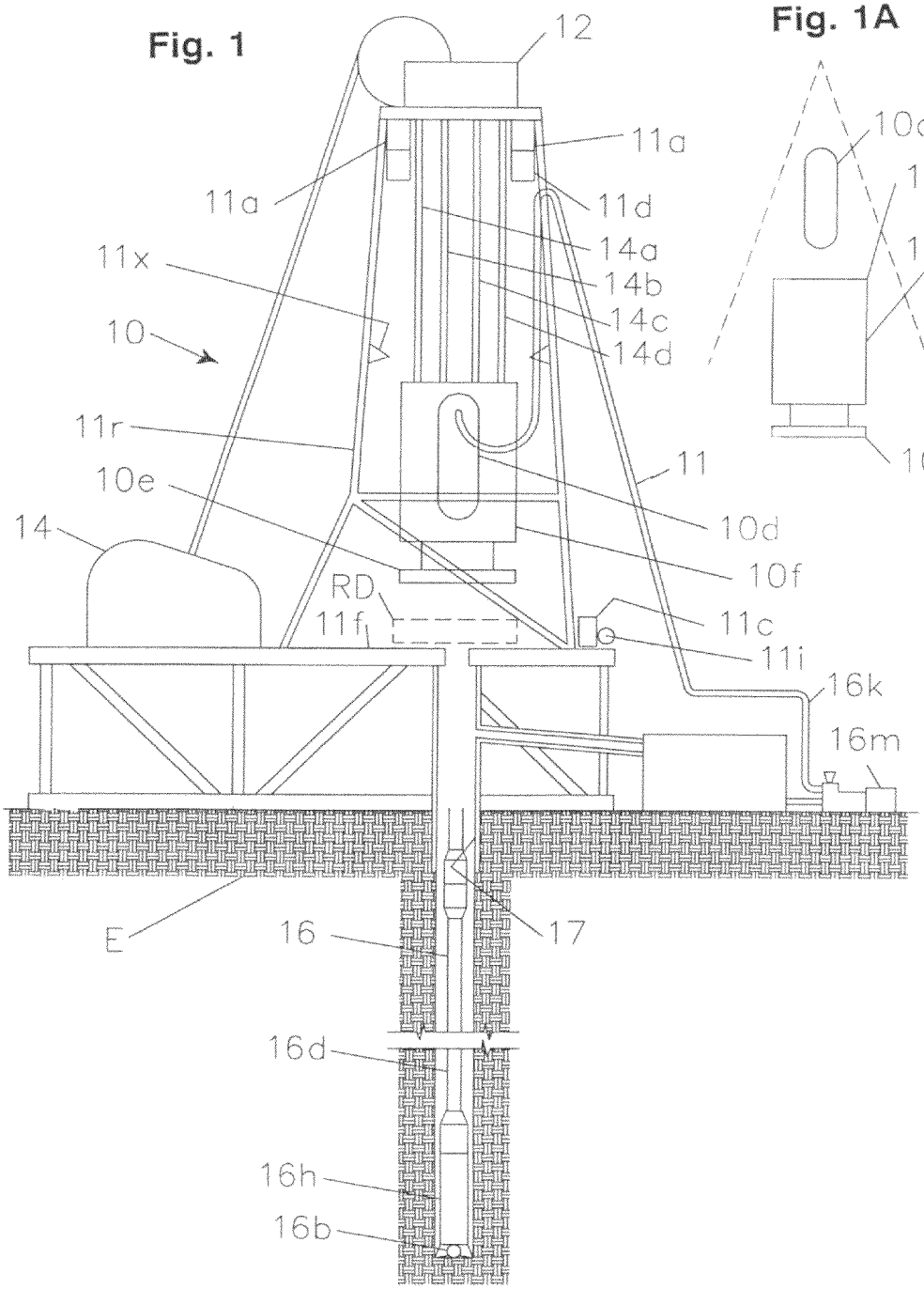

FIG. 1 is a schematic side view of a system according to the present invention.

Figure 1A:
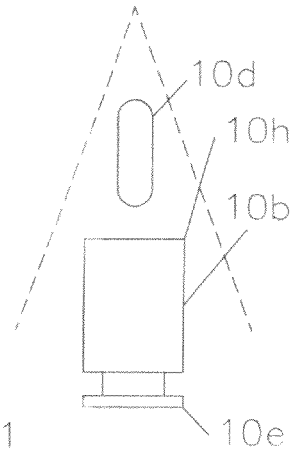

FIG. 1A shows parts of the system of FIG. 1, a drive subsystem separated from a hoist subsystem.

Figure 2A:
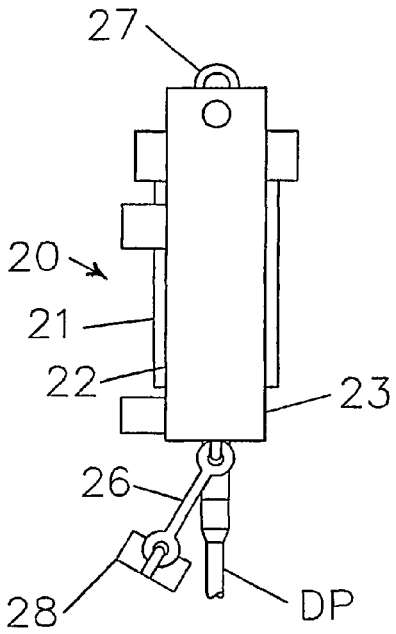

FIG. 2A is a side schematic view of a system according to the present invention.

Figure 2B:
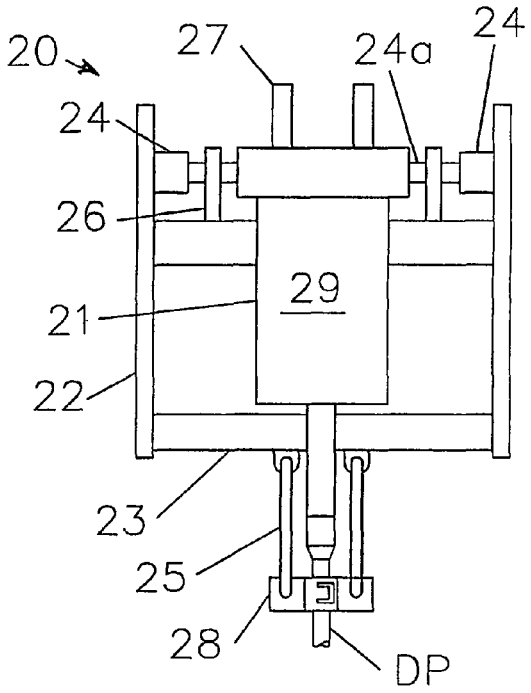

FIG. 2B is a front schematic view of the system of FIG. 2A.

Figure 2C:
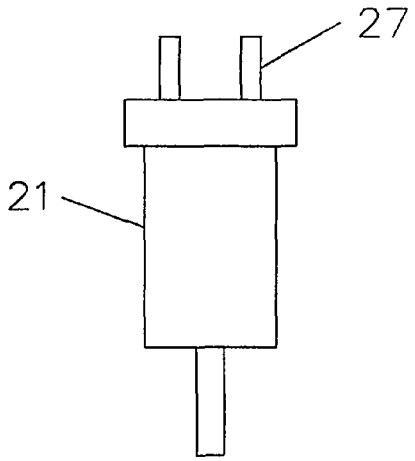

FIG. 2C is a front schematic view of the drive subsystem of the system of FIG. 2A.

Figure 3A:
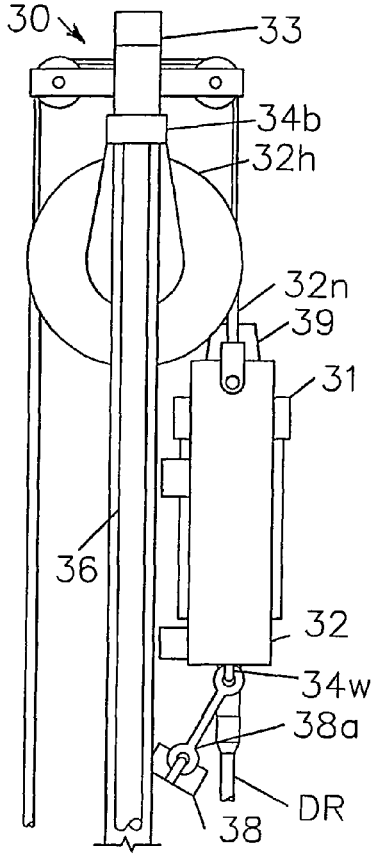

FIG. 3A is a side schematic view of a system according to the present invention.

Figure 3B:
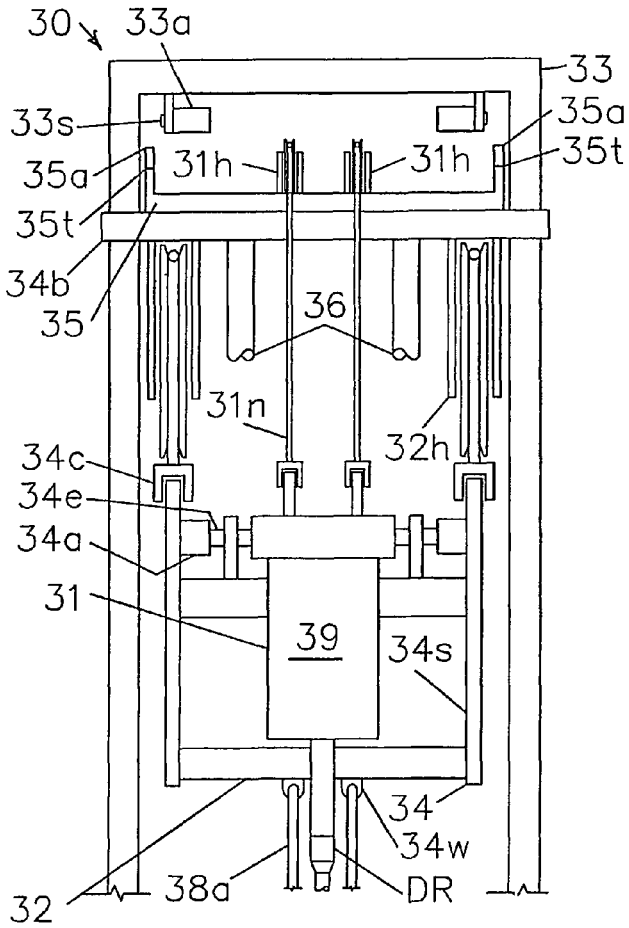

FIG. 3B is a front view of the system of FIG. 3A.

Figure 3C:
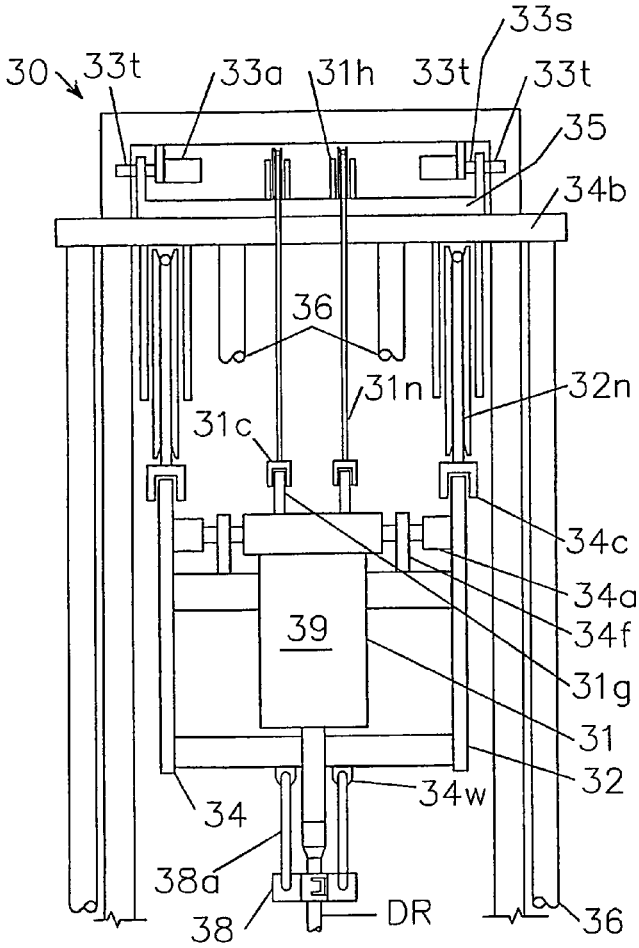

FIG. 3C is a front view of the system of FIG. 3A.

Figure 3D:
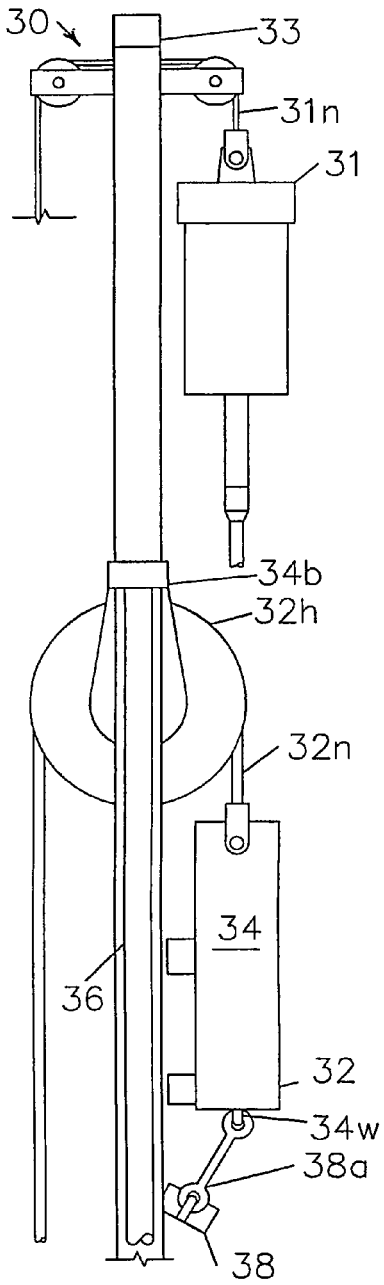

FIG. 3D is a side view of the system of FIG. 3A.

Figure 3E:
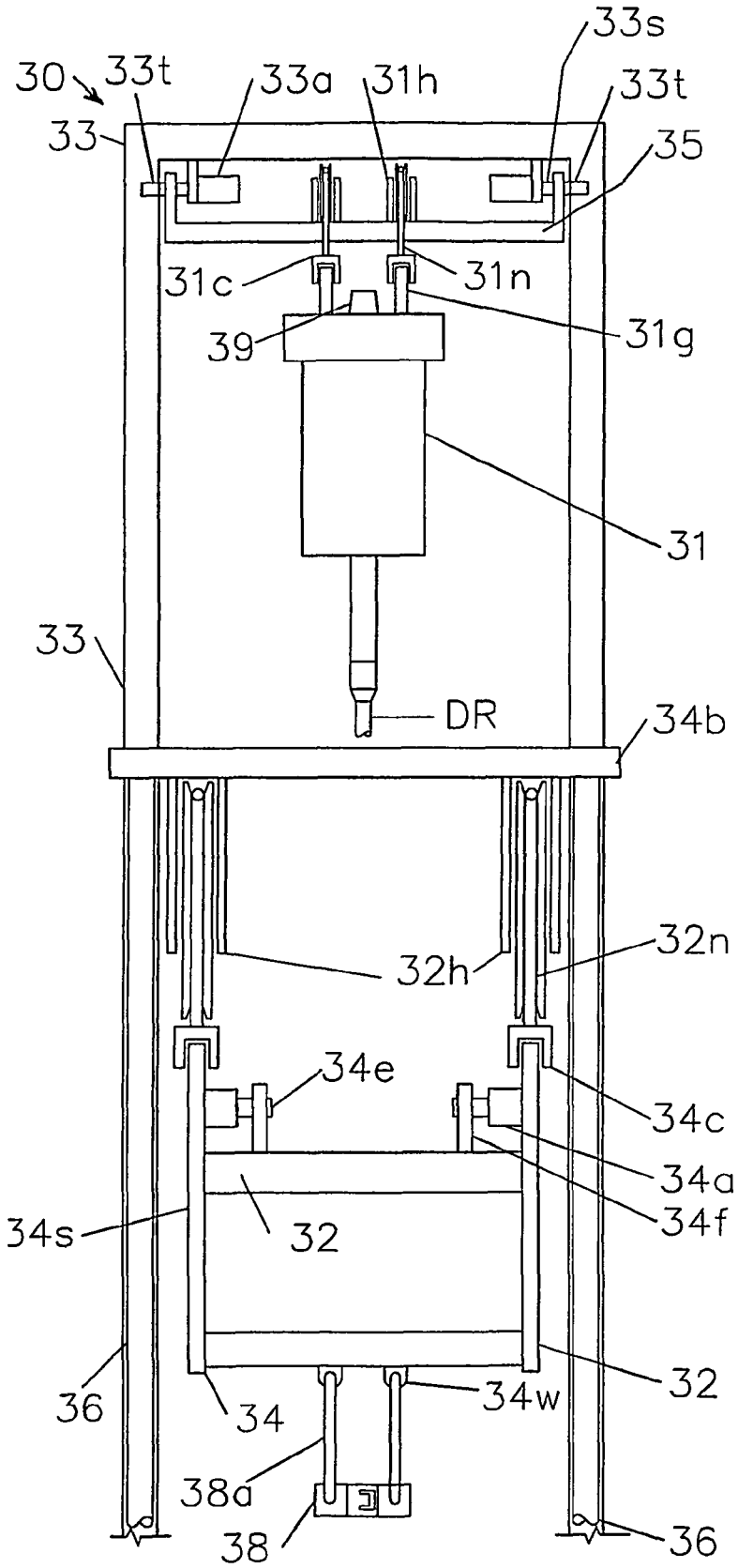

FIG. 3E is a front view of the system of FIG. 3A.

Figure 4:
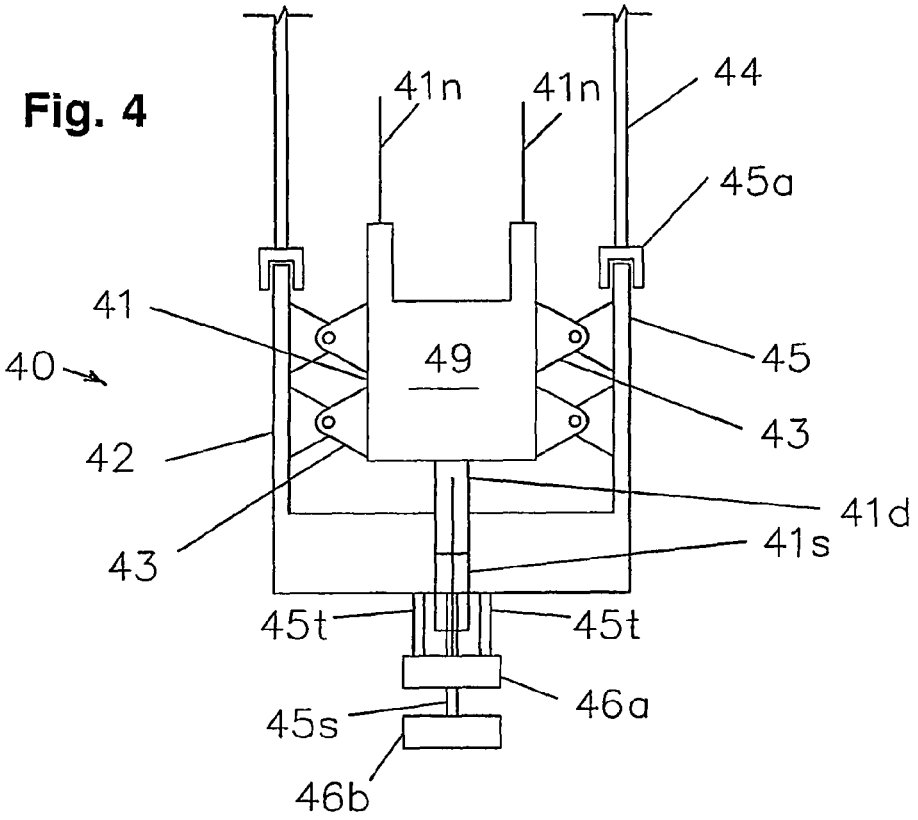

FIG. 4 is a schematic front view of a system according to the present invention.

Figure 4A:
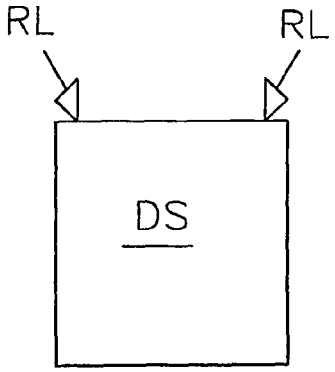

FIG. 4A is a schematic front view of a drive system according to the present invention.

Figure 4B:
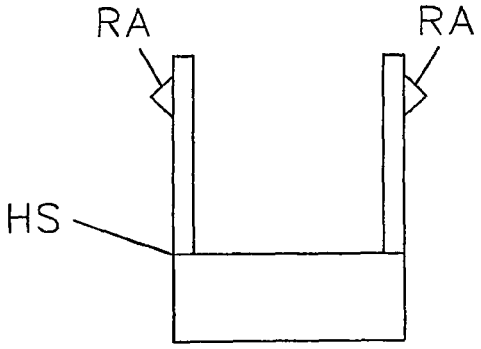

FIG. 4B is a schematic front view of a hoist system according to the present invention.

Figure 5A:
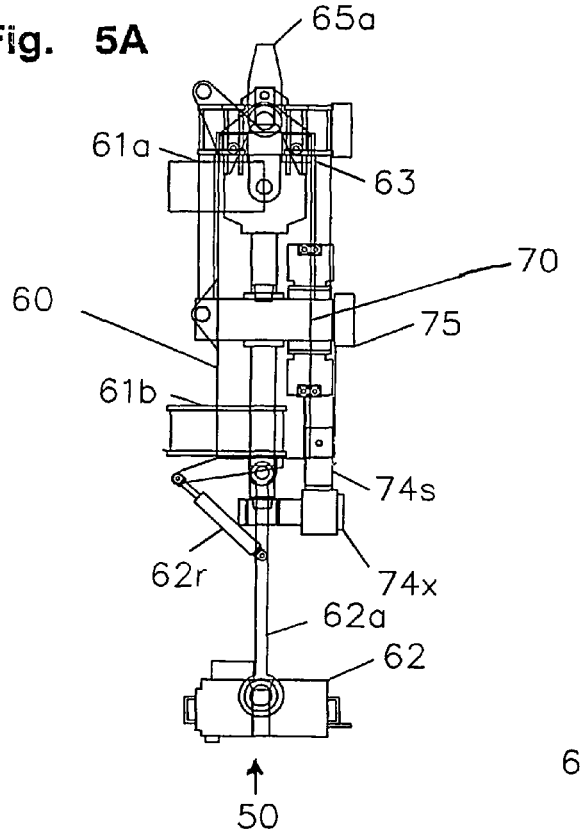
Figure 5F:
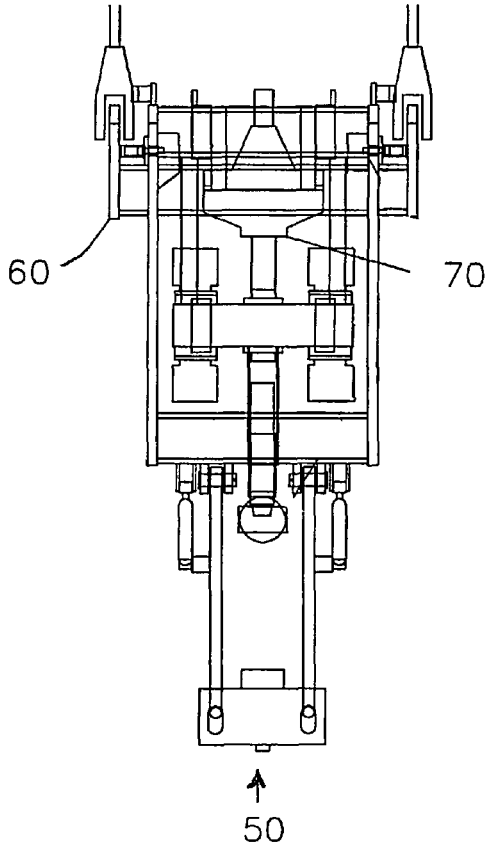
Figure 5G:
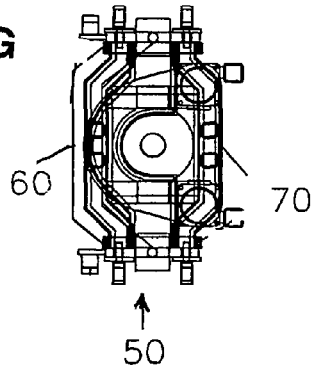

FIG. 5A is a perspective view of a system according to the present invention.

Figure 5B:
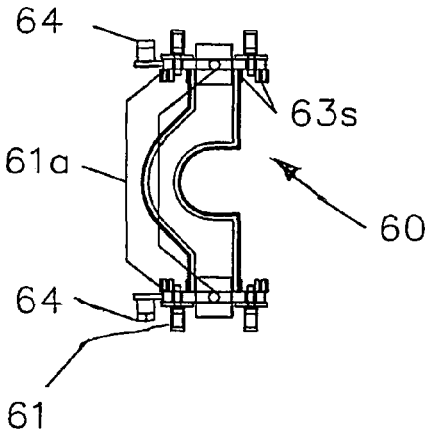
Figure 5E:
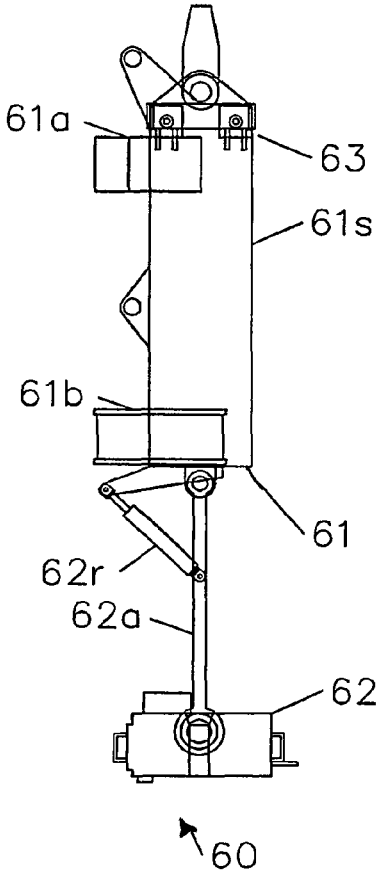
Figure 5C:
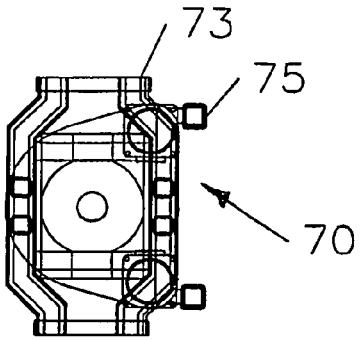
Figure 5D:
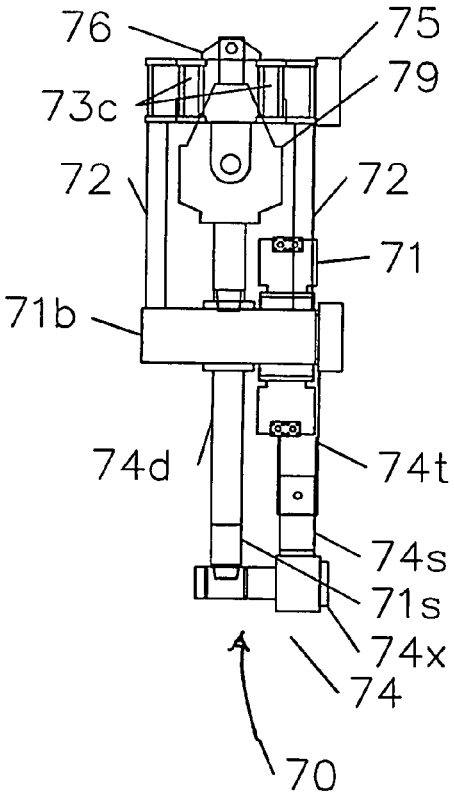

FIG. 5B is a perspective view of a hoist system of the system of FIG. 5A FIG. 5C is a perspective view of a drive system of the system of FIG. 5A.

Figure 6:
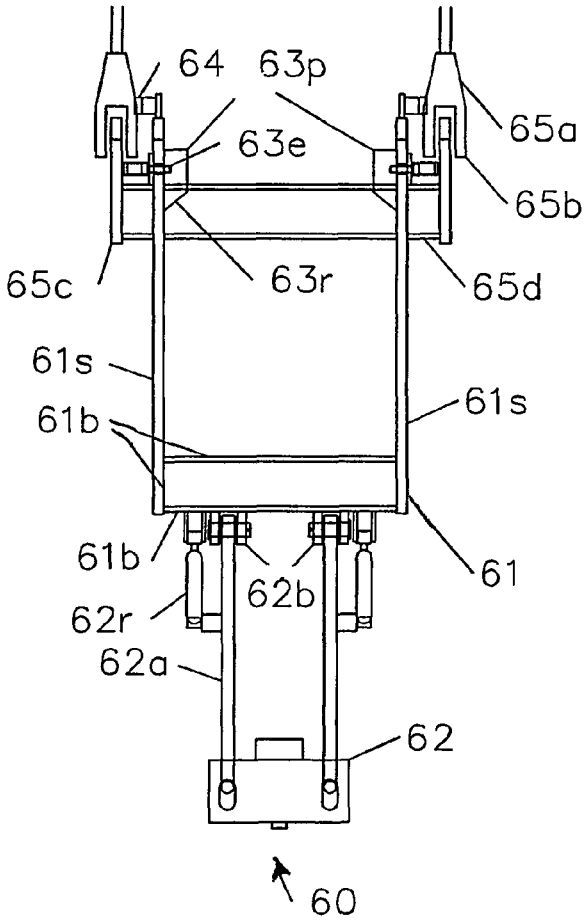

FIG. 6 is a perspective view of the hoist system shown in FIGS. 5A and 5B.

Figure 7:
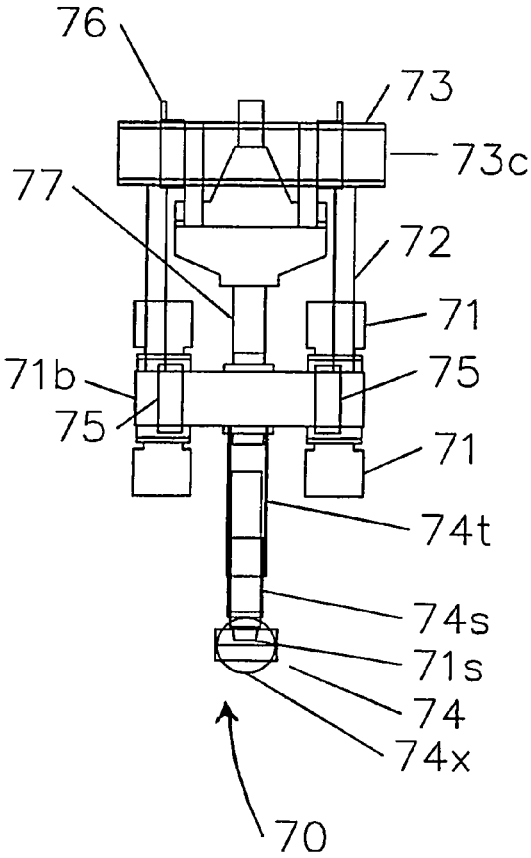

FIG. 7 is a perspective view of the drive system shown in FIGS. 5A and 5C.

Figure 8A:
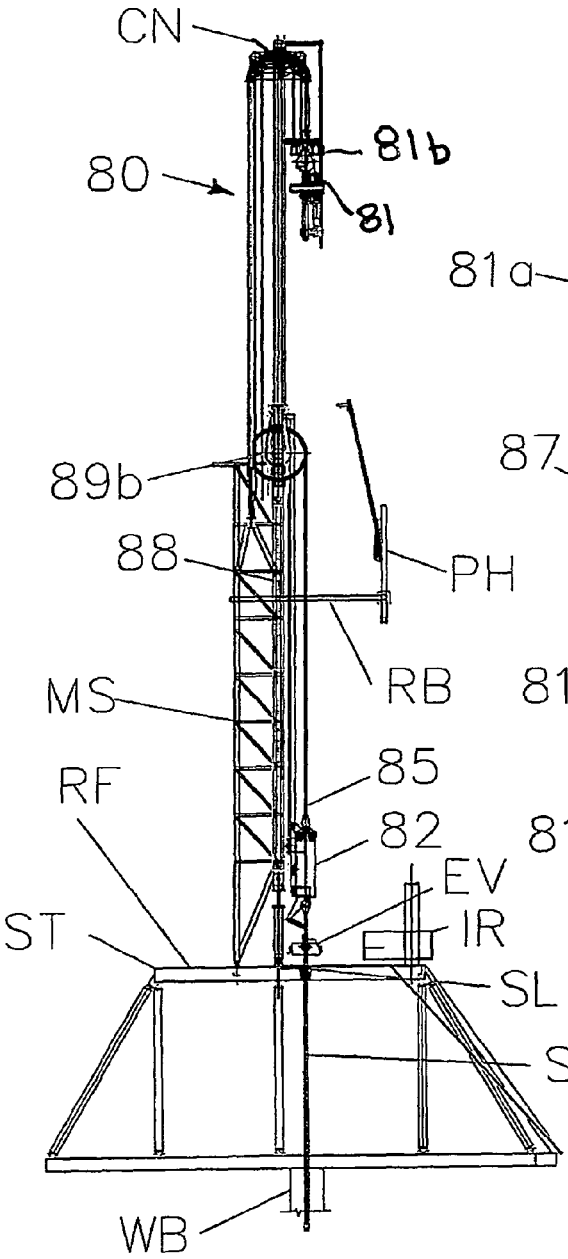

FIG. 8A is a side schematic view of a system according to the present invention.

Figure 8B:
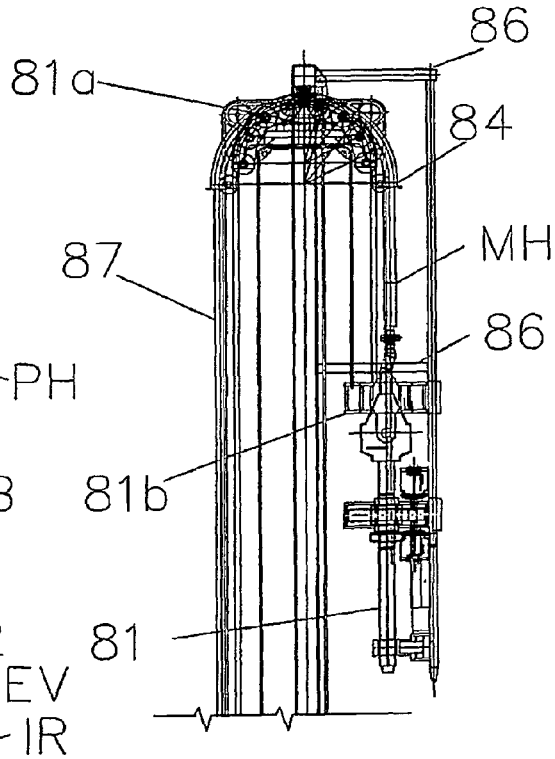

FIG. 8B is an enlarged side schematic view of part of the system of FIG. 8A.

Figure 8C:
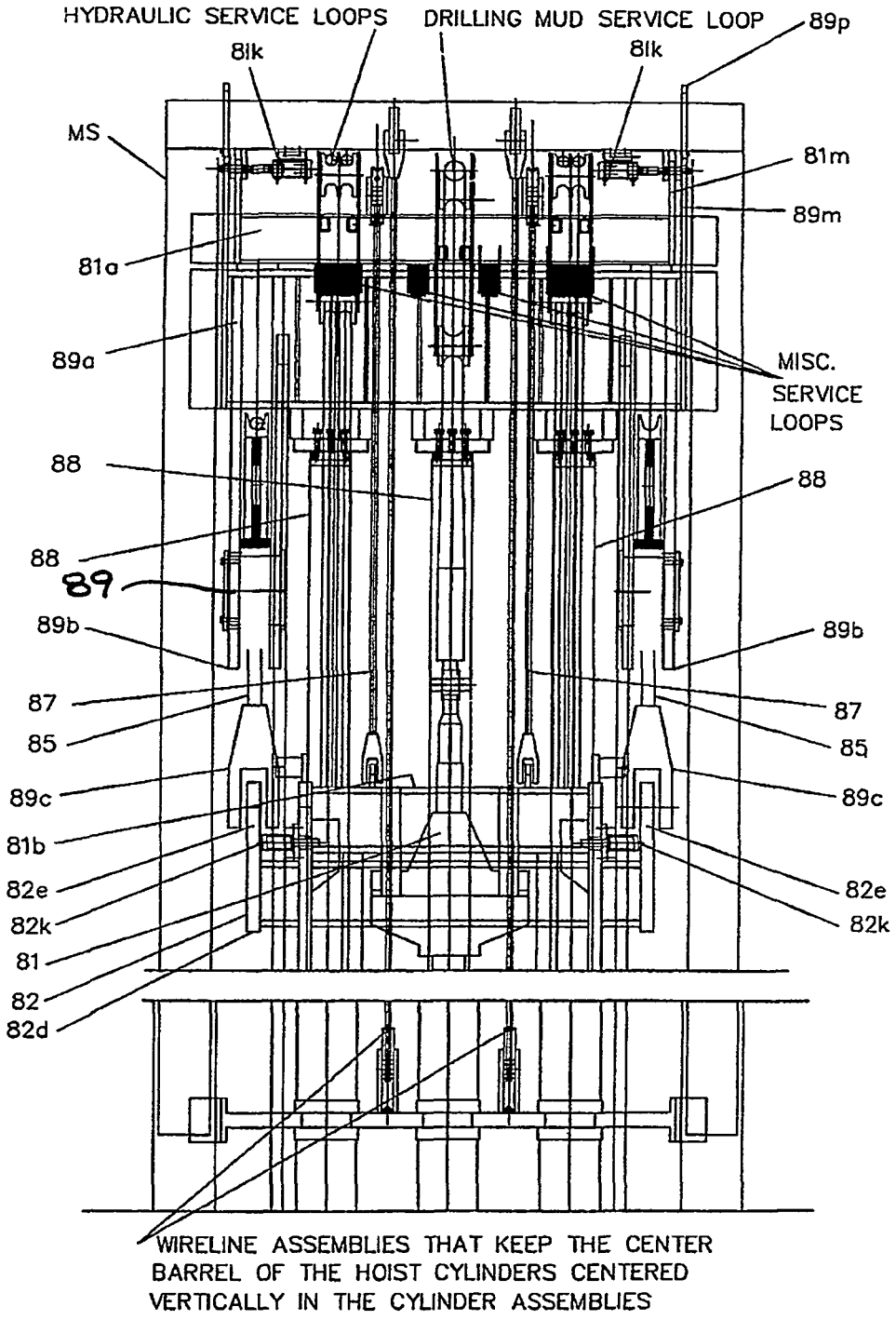

FIG. 8C is a front view of parts of the system of FIG. 8A.

Figure 8D:
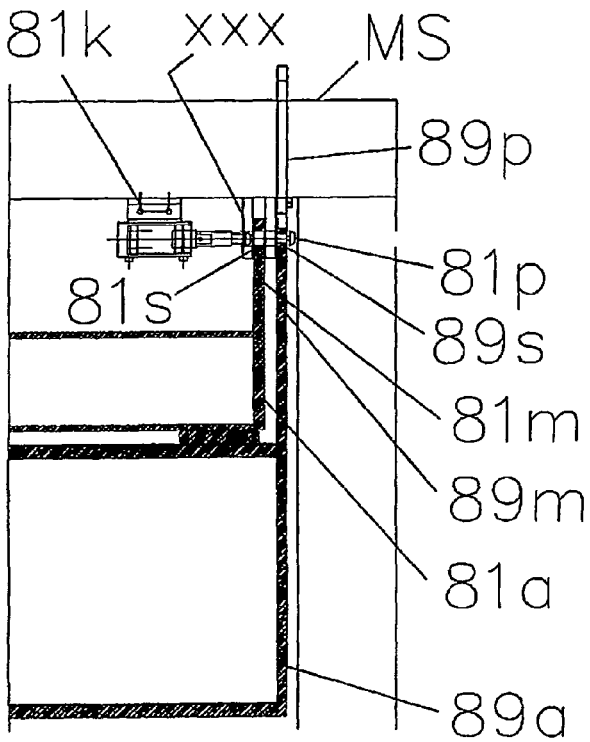

FIG. 8D is an enlarged view of parts shown in FIG. 8C.

Figure 8E:
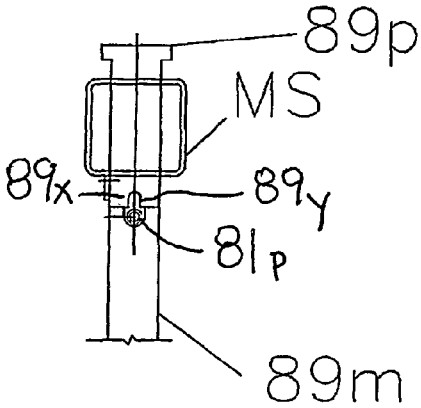

FIG. 8E is a side view of parts shown in FIG. 8C.

Figure 8F:
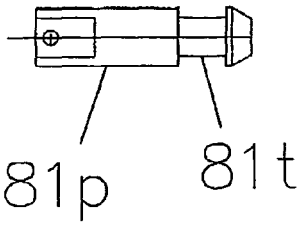

FIG. 8F is a side view of a pin of the system as shown in FIG. 8C.

Figure 8G:
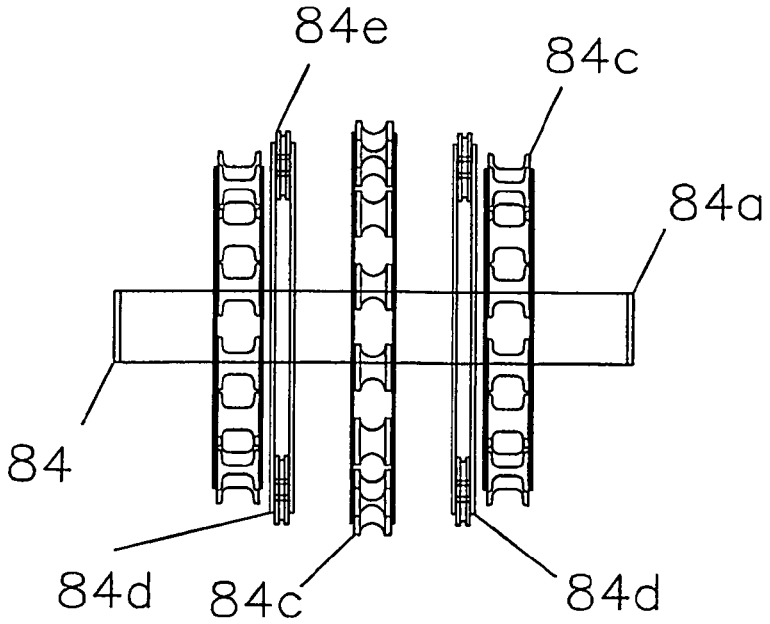

FIG. 8G is a perspective view of part of a loop system of the system of FIG. 8A.

Figure 8H:
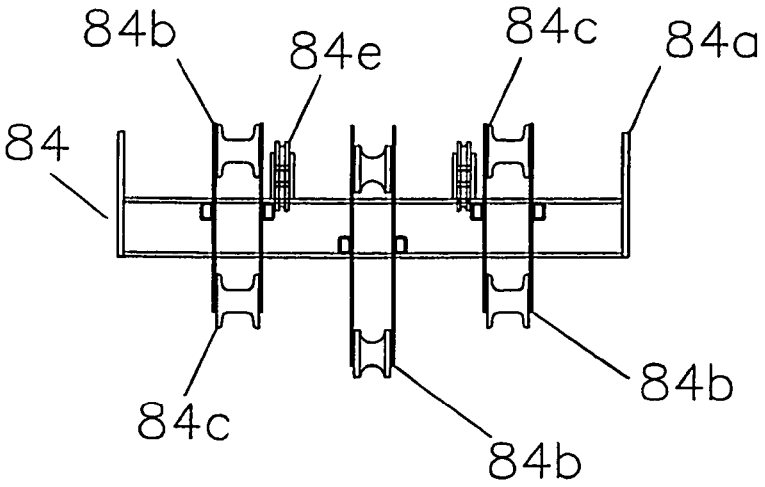

FIG. 8H is a perspective view of part of the loop system of FIG. 8G.

Figure 8I:
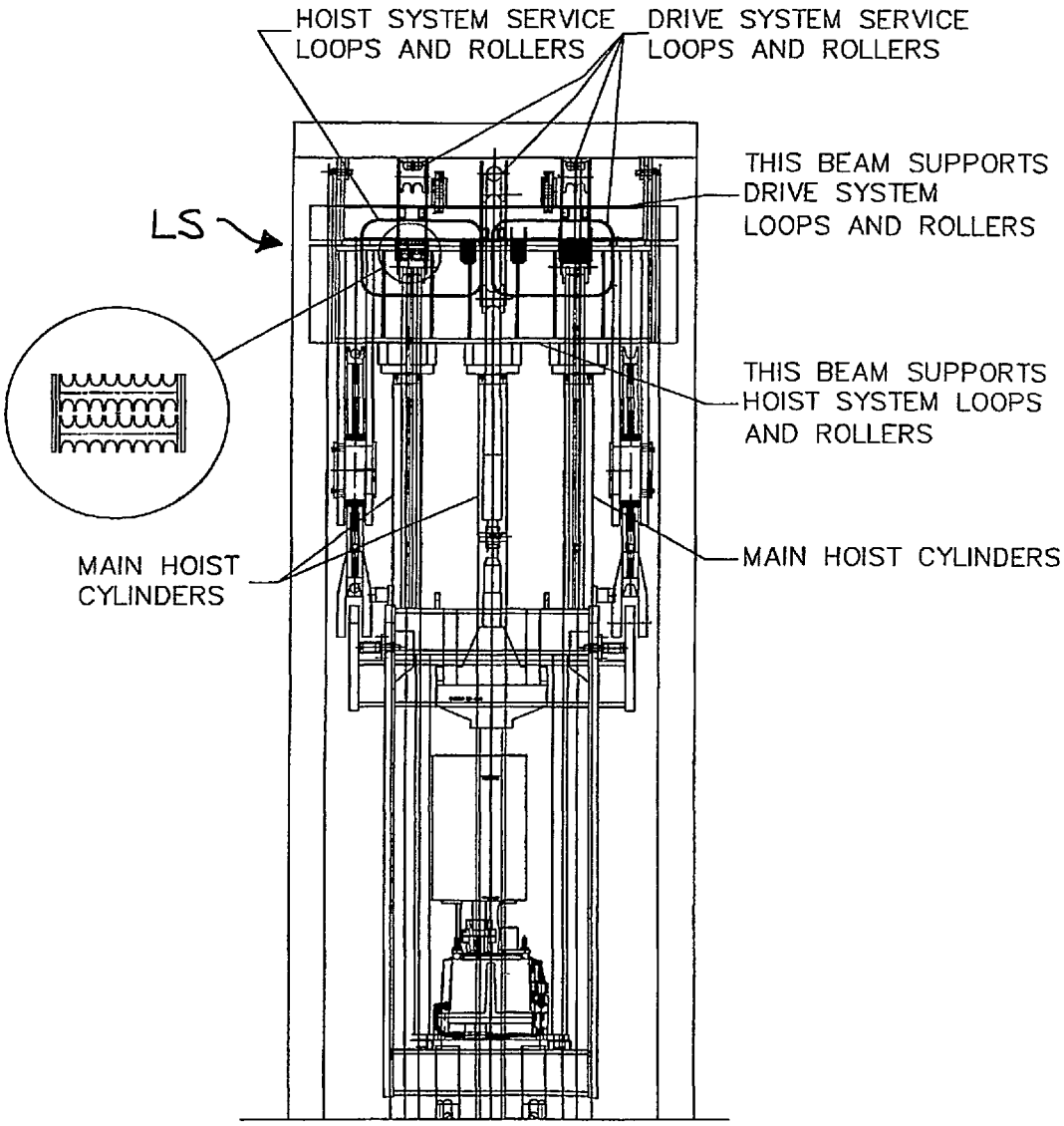

FIG. 8I is a front view of a system according to the present invention showing parts of a loop system, drive system and hoist system according to the present invention as shown in FIG. 8A.

Figure 8J:
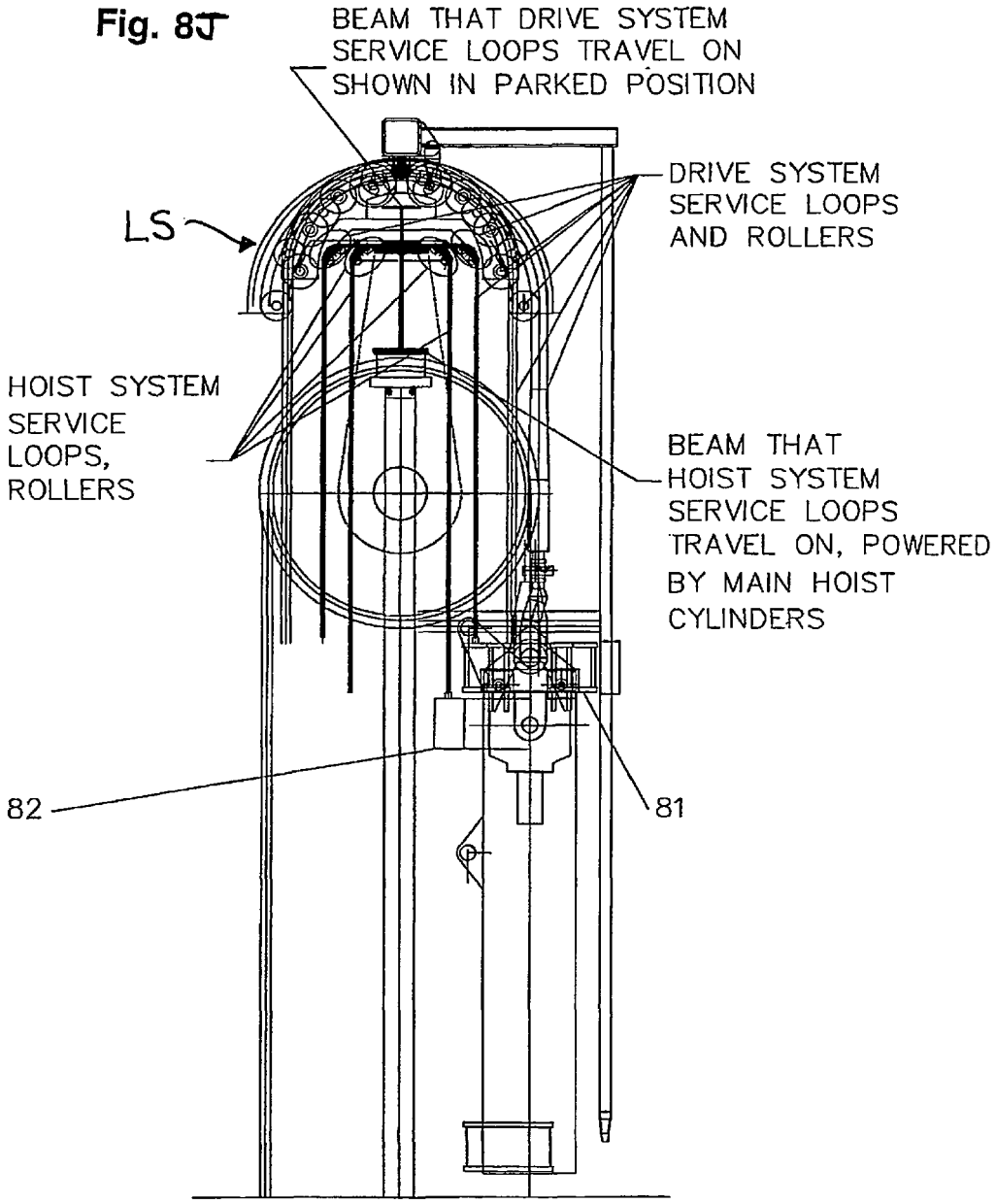

FIG. 8J is a side view of parts of the loop system as shown in FIG. 8I.

Figure 8K:
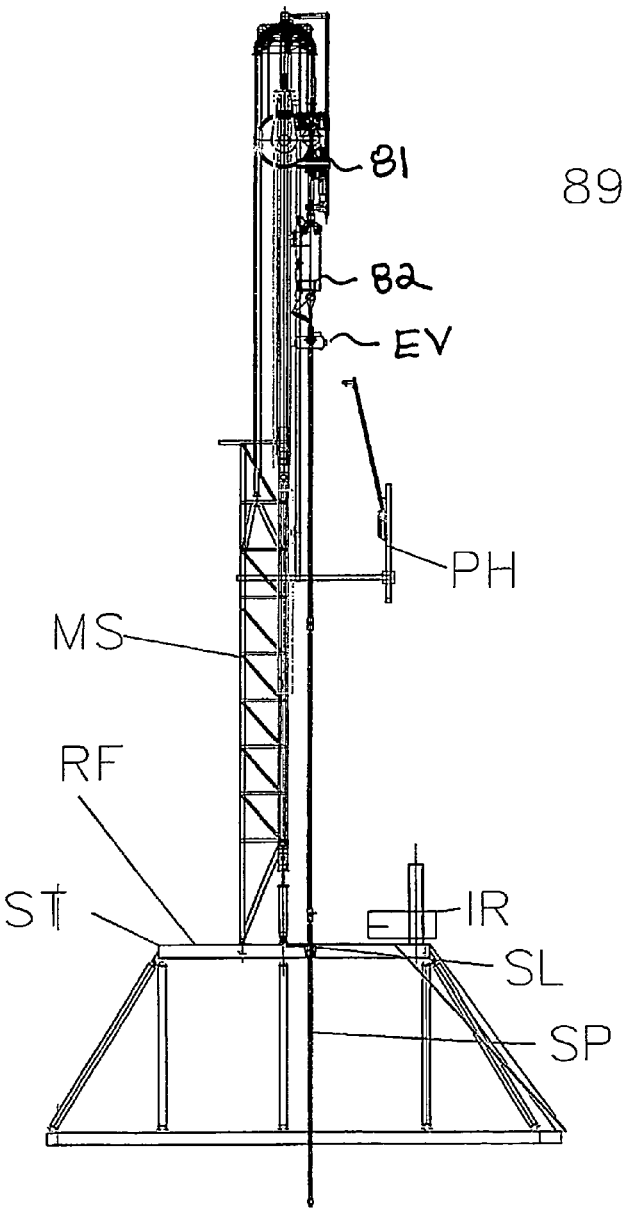

FIG. 8K is a side schematic view showing a step in a method using the system of FIG. 8A.

Figure 8L:
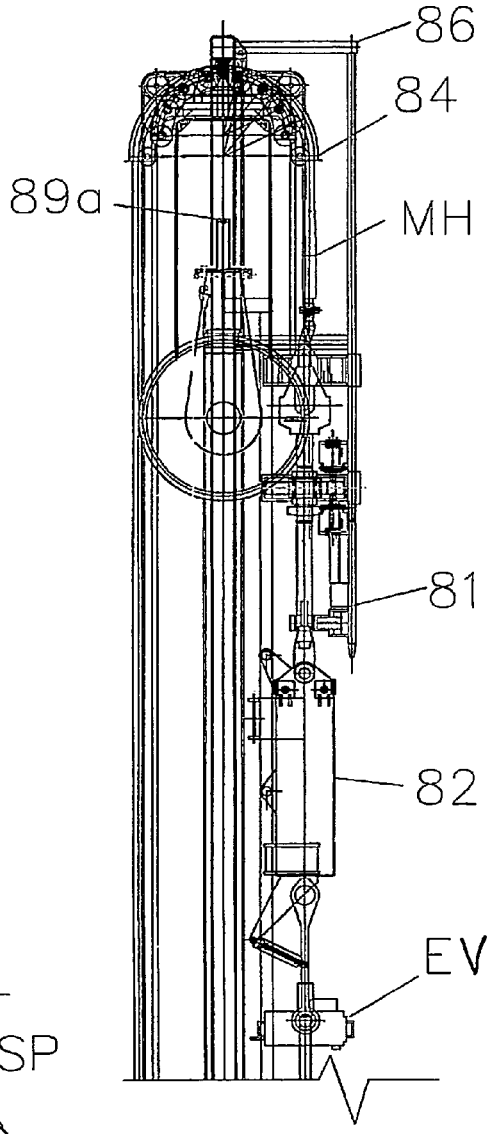

FIG. 8L is an enlarged view of part of the system as shown in FIG. 8K.

Figure 8M:
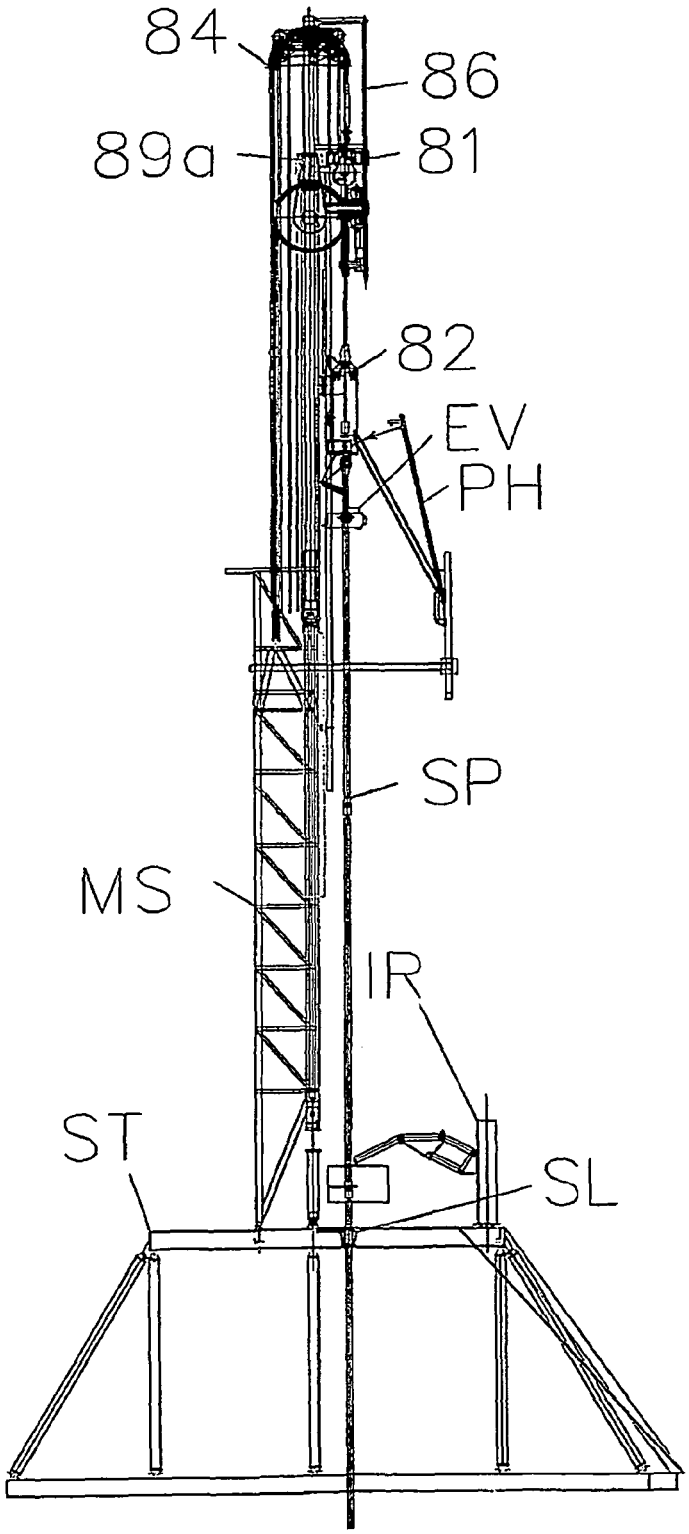

FIG. 8M is a side schematic view showing a step in a method using the system of FIG. 8A.

Figure 8N:
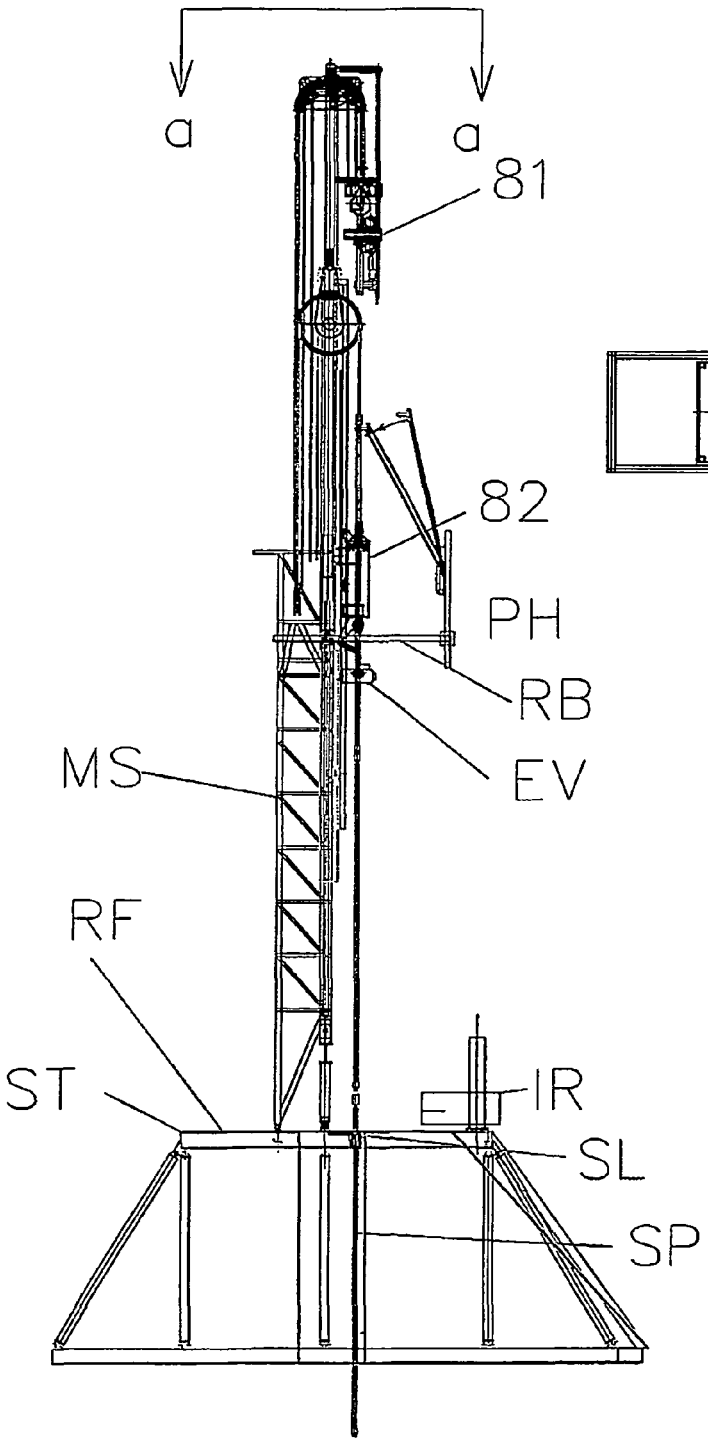

FIG. 8N is a side schematic view showing a step in a method using the system of FIG. 8A.

Figure 8O:
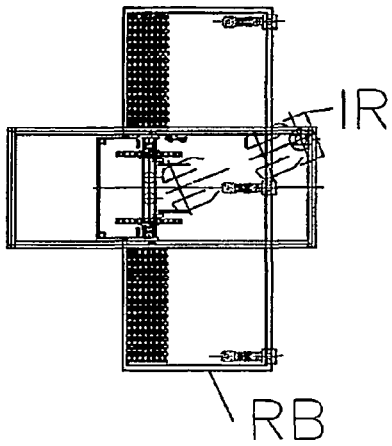

FIG. 8O is a view along line a-a of FIG. 8N.

Figure 8P:
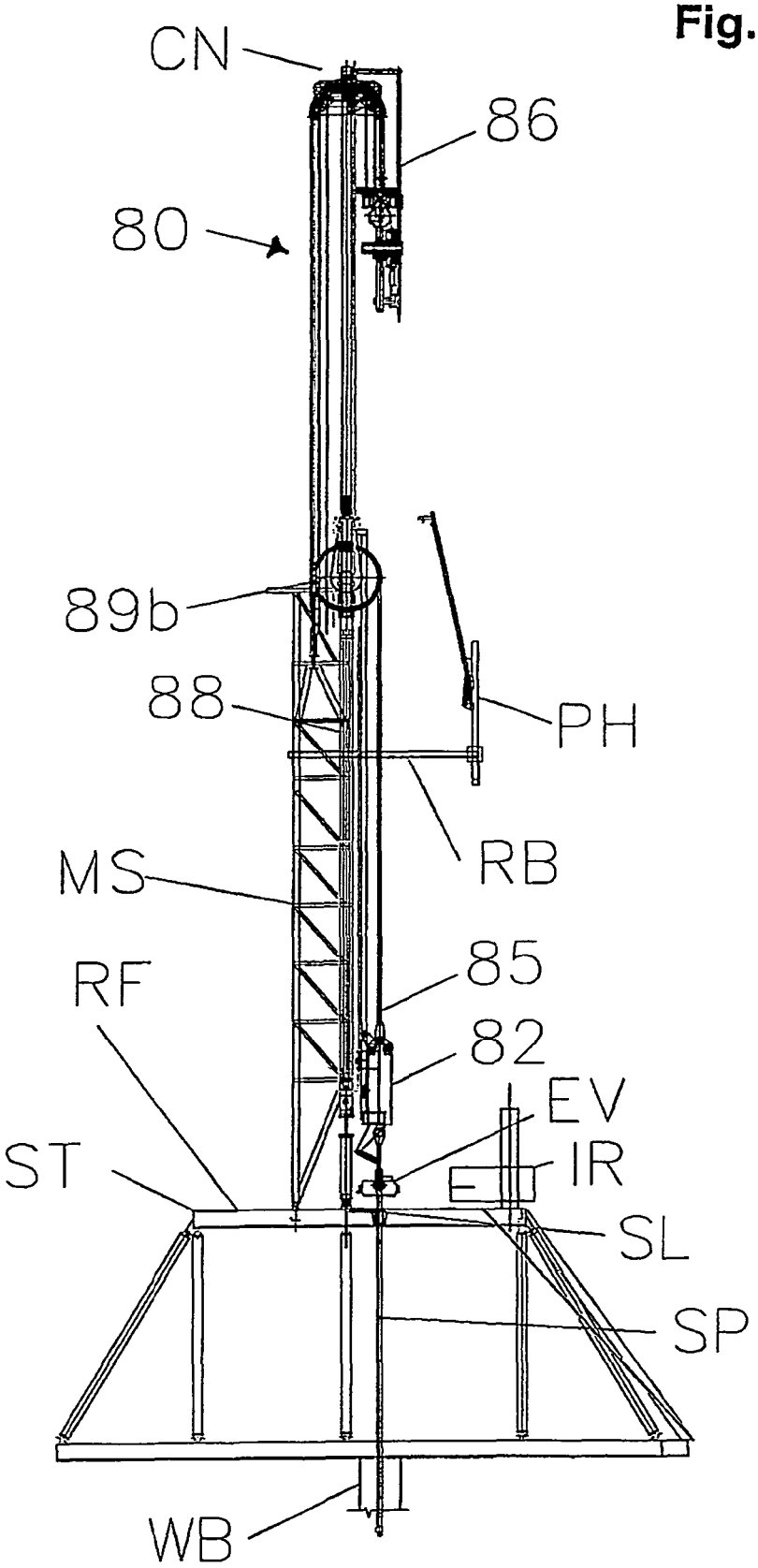

FIG. 8P is a side schematic view showing a step in a method using the system of FIG. 8A.

Figure 9A:
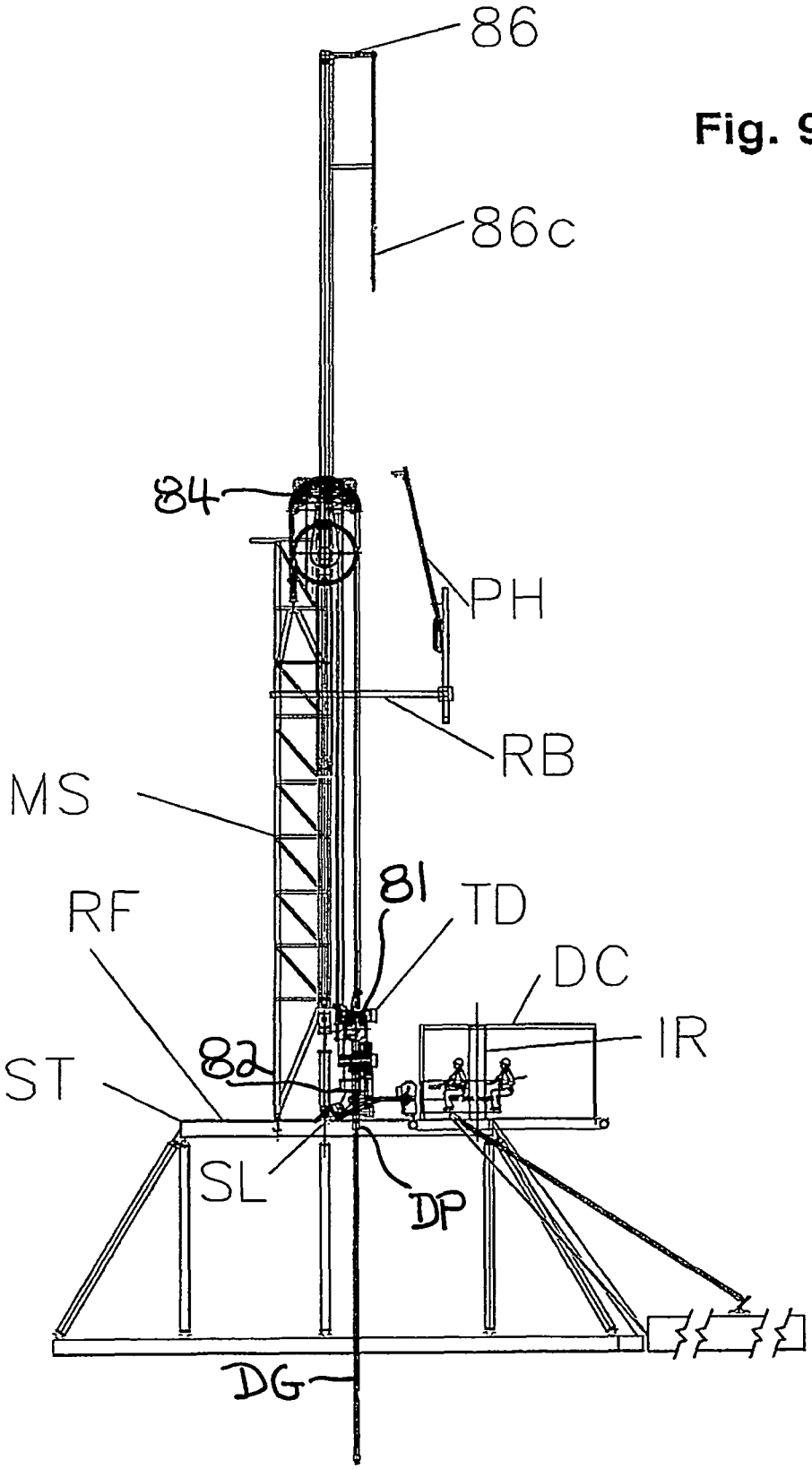

FIG. 9A is a side schematic view of a system according to the present invention.

Figure 9B:
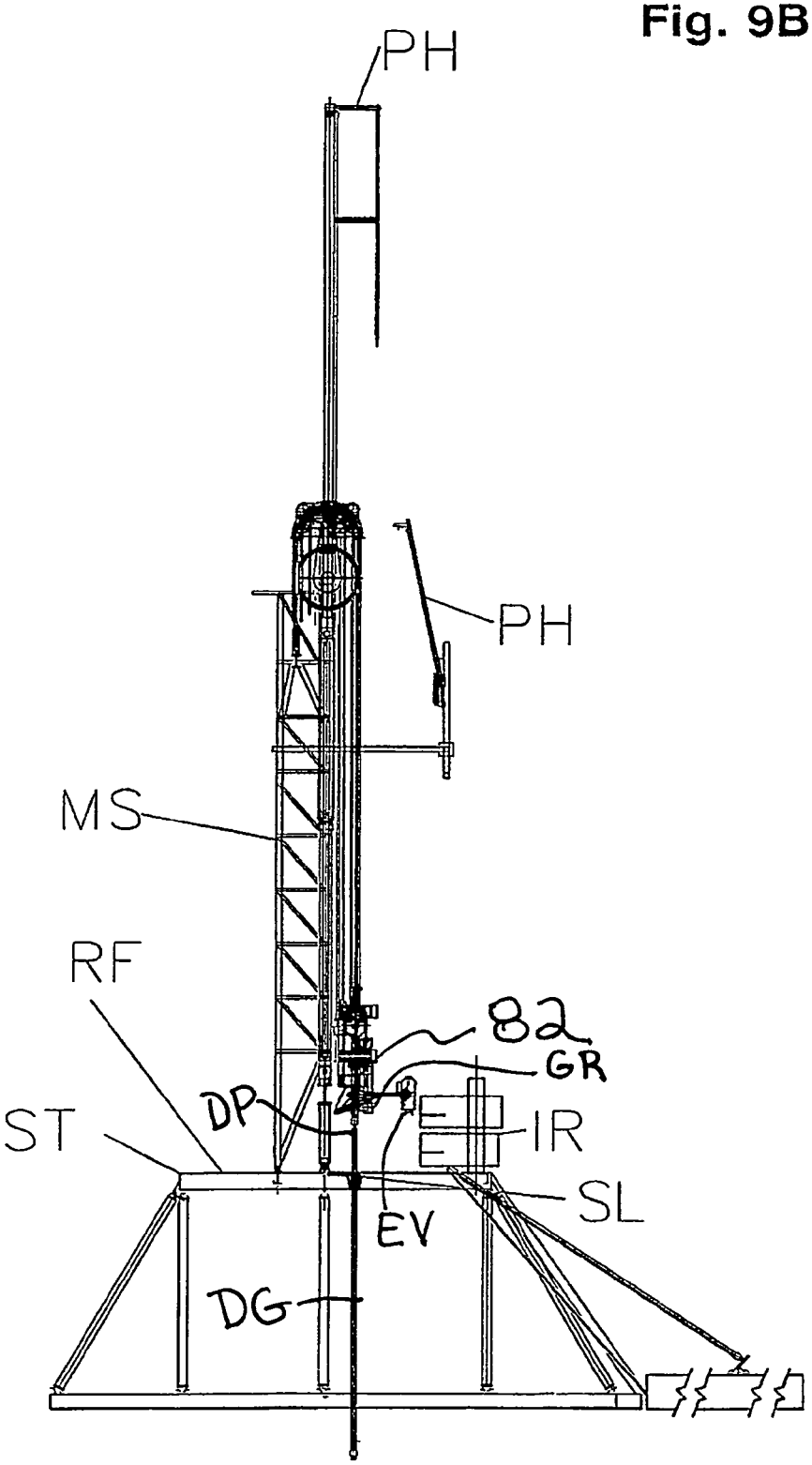

FIG. 9B is a side schematic view of the system of FIG. 9A showing a step in a method according to the present invention.

Figure 9C:
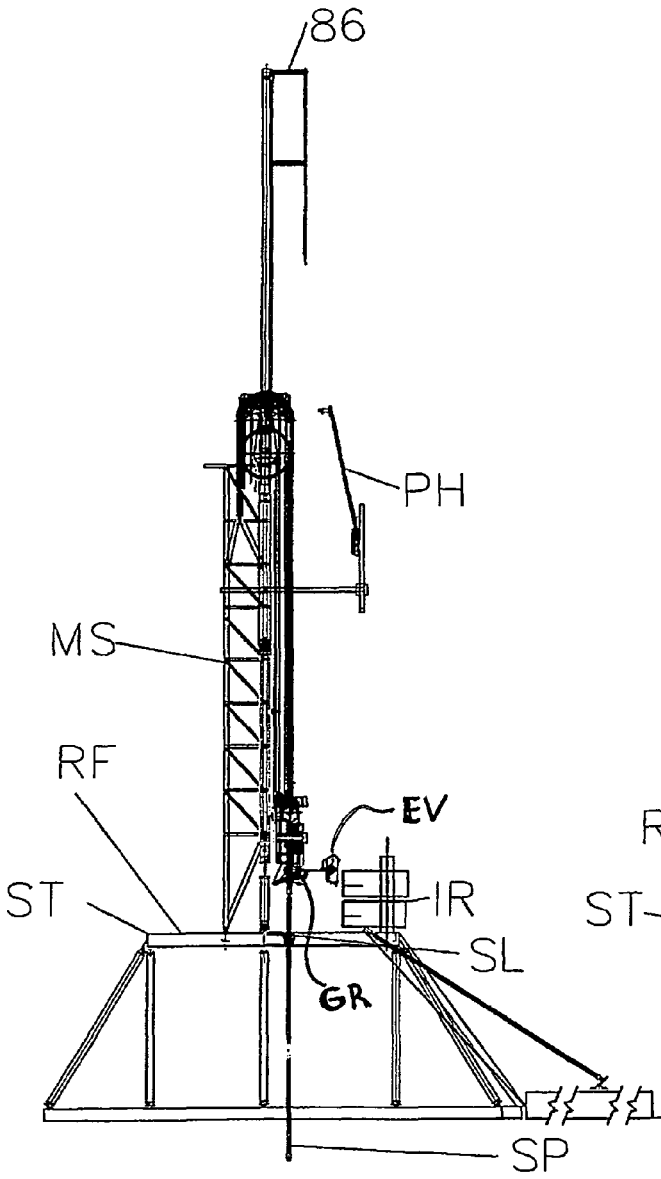

FIG. 9C is a side schematic view of the system of FIG. 9A showing a step in a method according to the present invention.

Figure 9D:
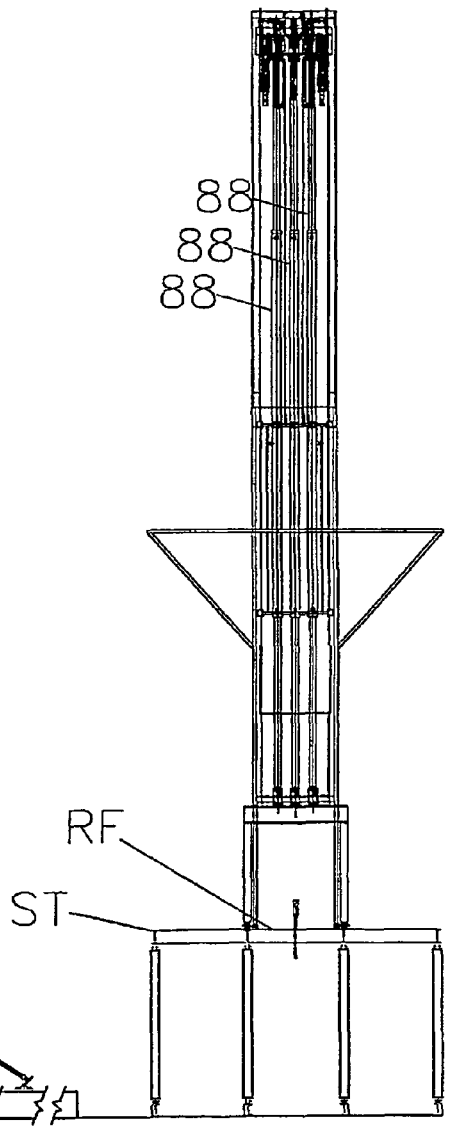

FIG. 9D is an front view of the system as shown in FIG. 9C.

Figure 9E:
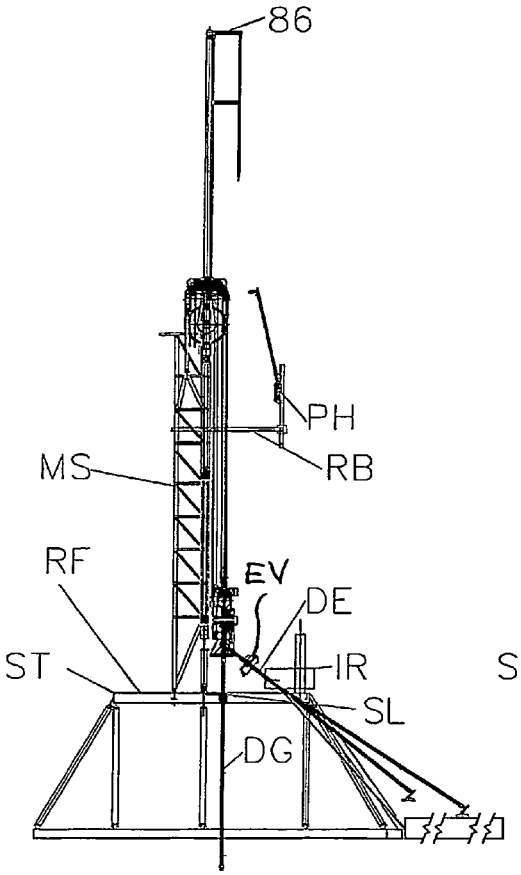

FIG. 9E is a side schematic view showing a step in a method using the system of FIG. 9A.

Figure 9F:
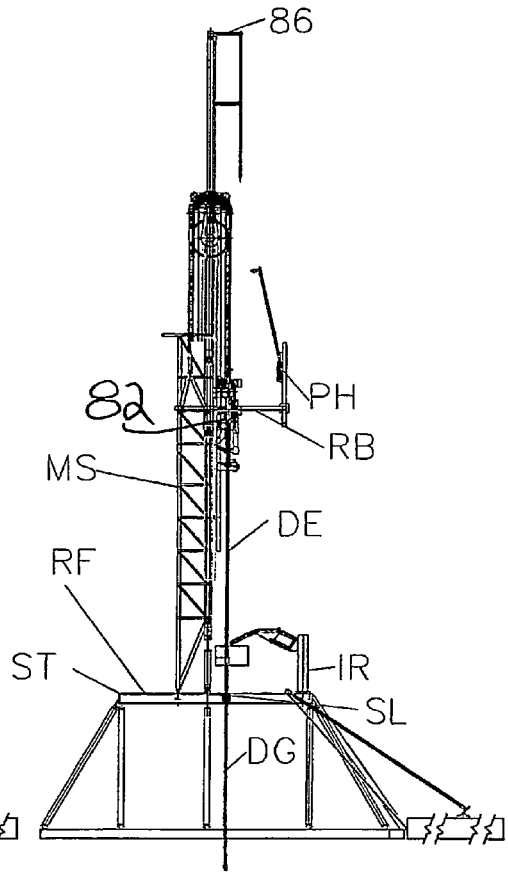

FIG. 9F is a side schematic view showing a step in a method using the system of FIG. 9A.

Figure 9G:
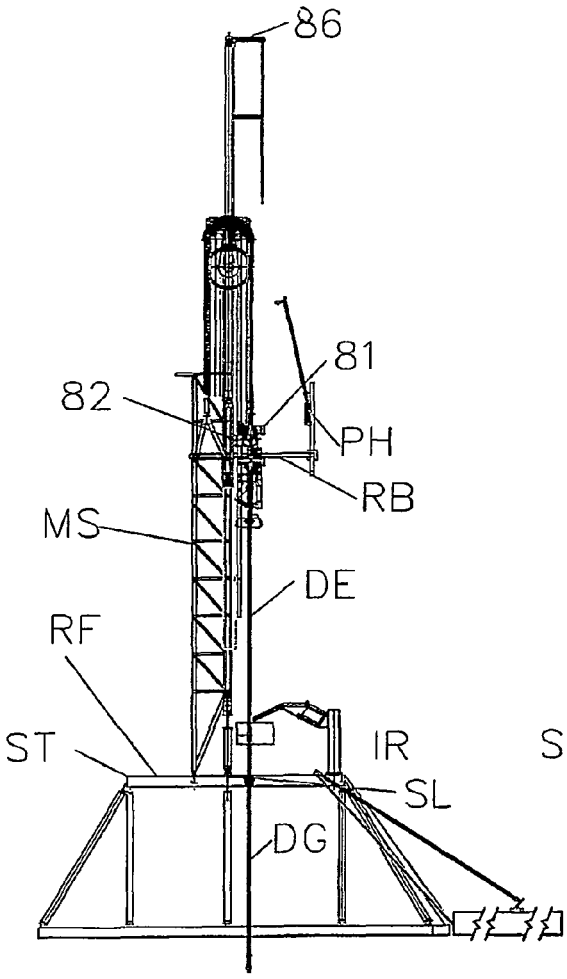

FIG. 9G is a side schematic view showing a step in a method using the system of FIG. 9A.

Figure 9H:
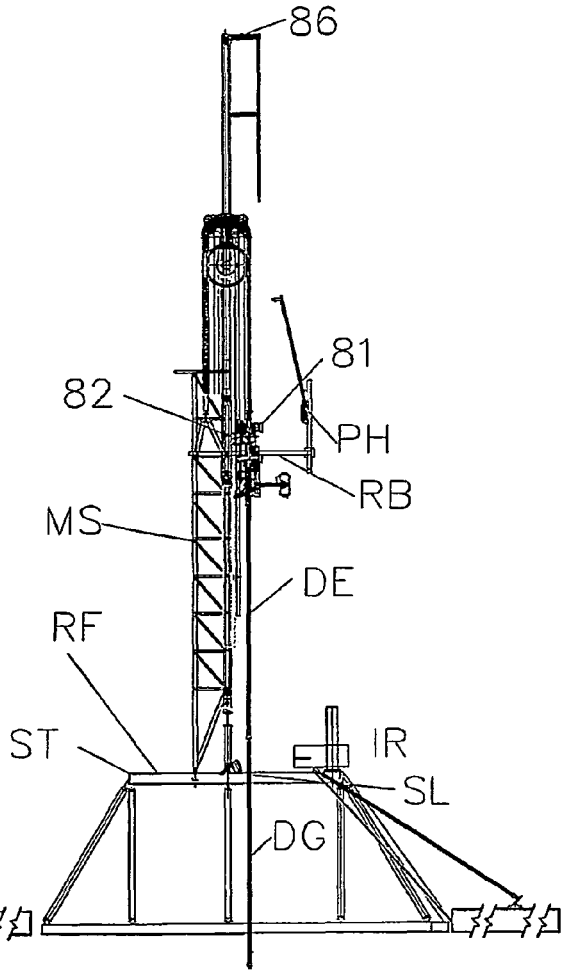

FIG. 9H is a side schematic view showing a step in a method using the system of FIG. 9A.

Figures 10A, 10B:
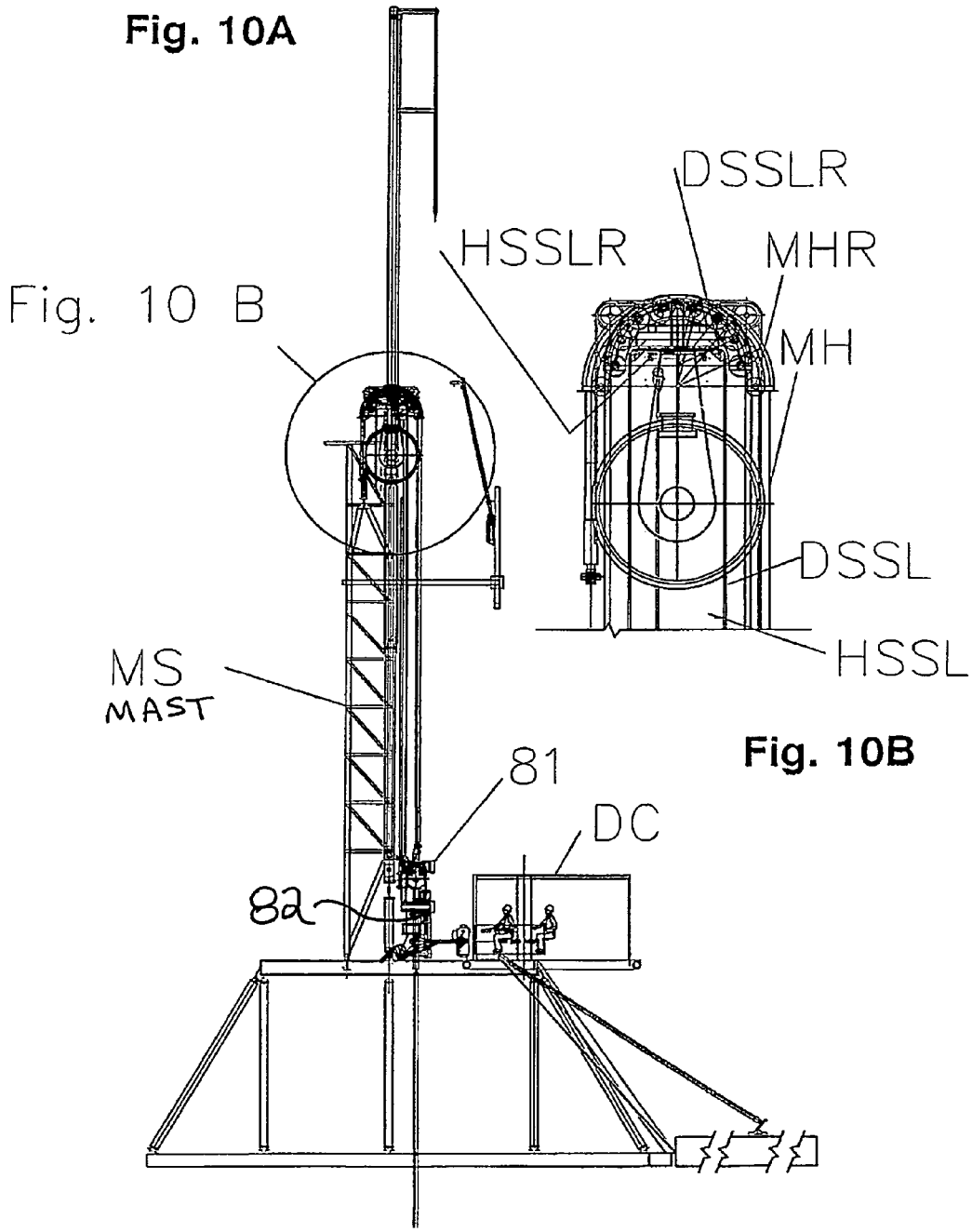

FIG. 10A is a side schematic view of a system according to the present invention.

FIG. 10B is an enlargement of part of the system of FIG. 10A.

Figure 11:
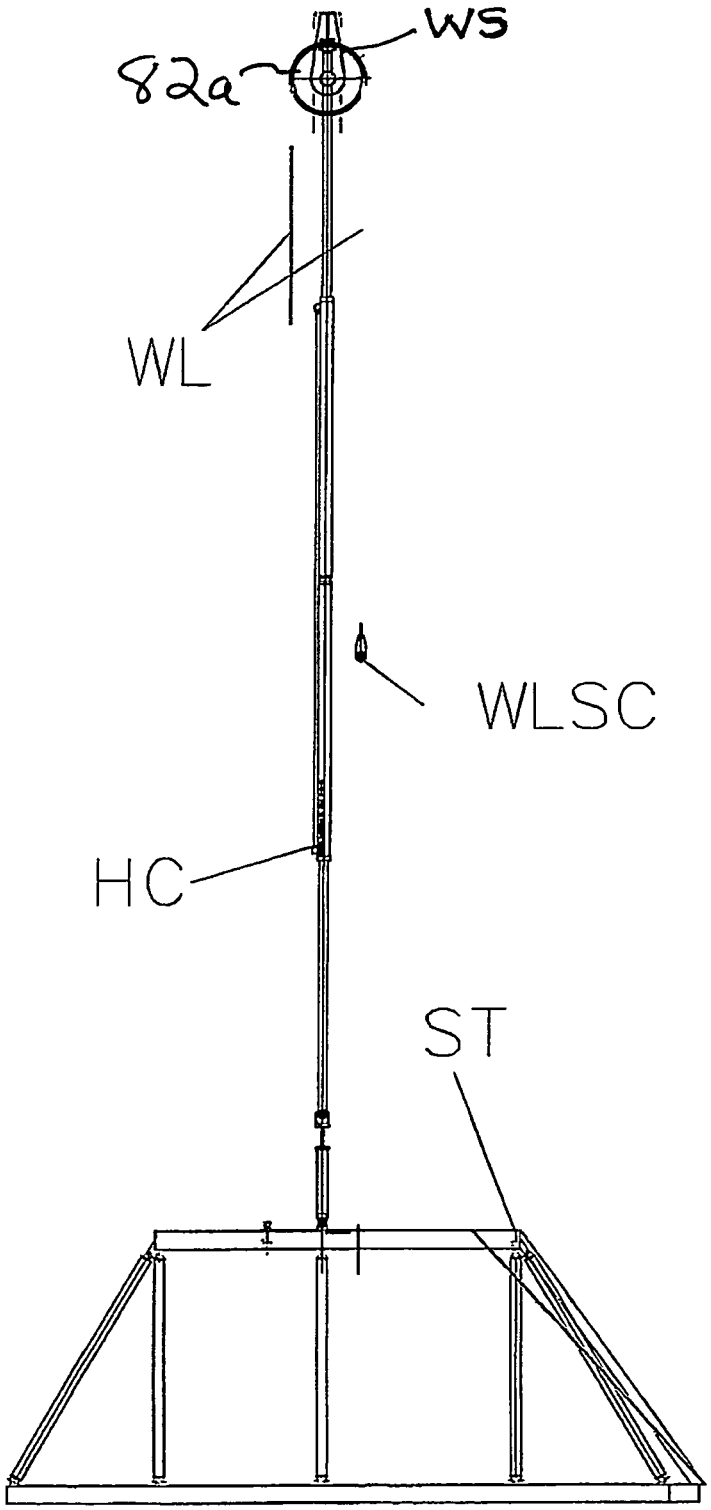

FIG. 11 is a side schematic view of a system according to the present invention.

FIG. 12A is a side schematic view of a system according to the present invention.

FIG. 12B is a top view of part of the system of FIG. 12A.

Figure 12C:
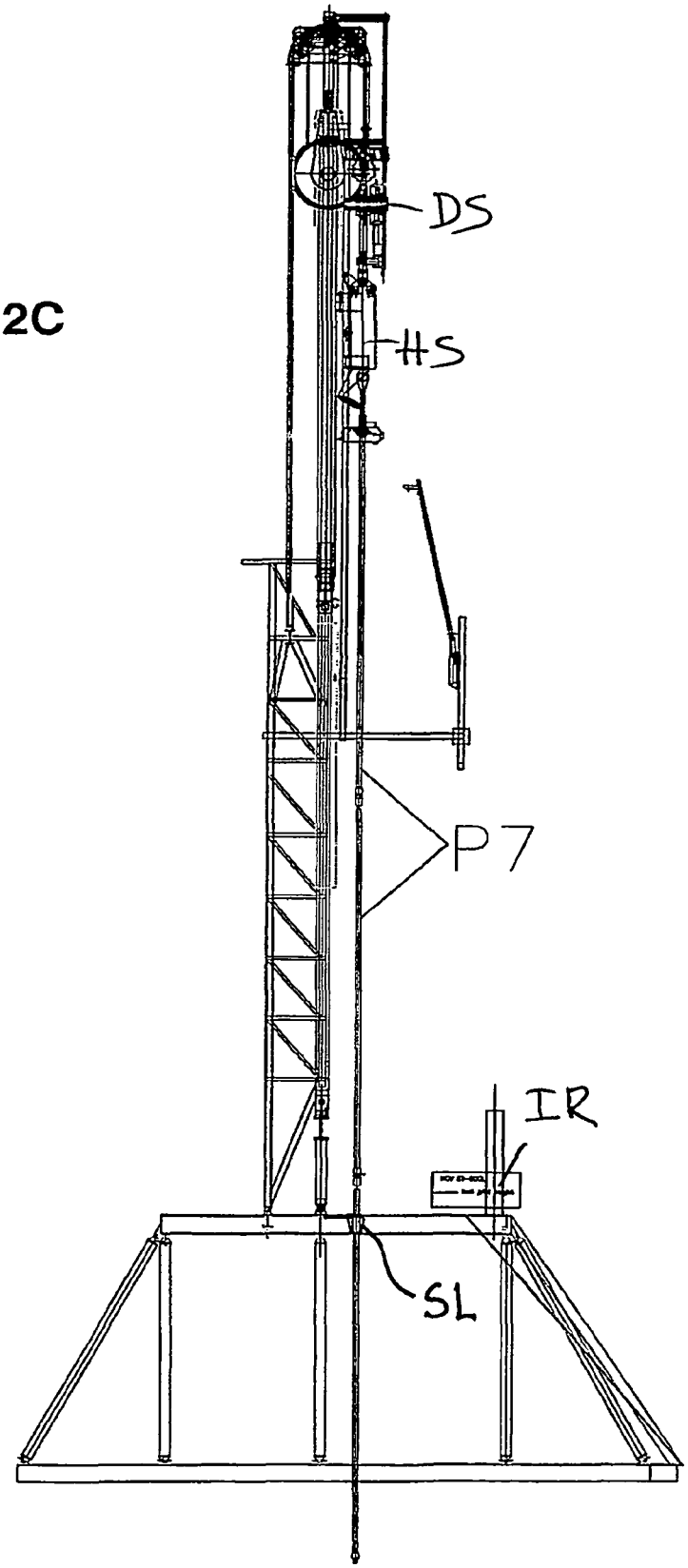

FIG. 12C is a side of the system of FIG. 12A as used in a step of a method according to the present invention.

FIG. 12D is a side of the system of FIG. 12A as used in a step of a method according to the present invention.

FIG. 12E is a top view of part of the system as shown in FIG. 12D.

FIG. 12F is a top view of part of the system as shown in FIG. 12D.

Figure 12G:
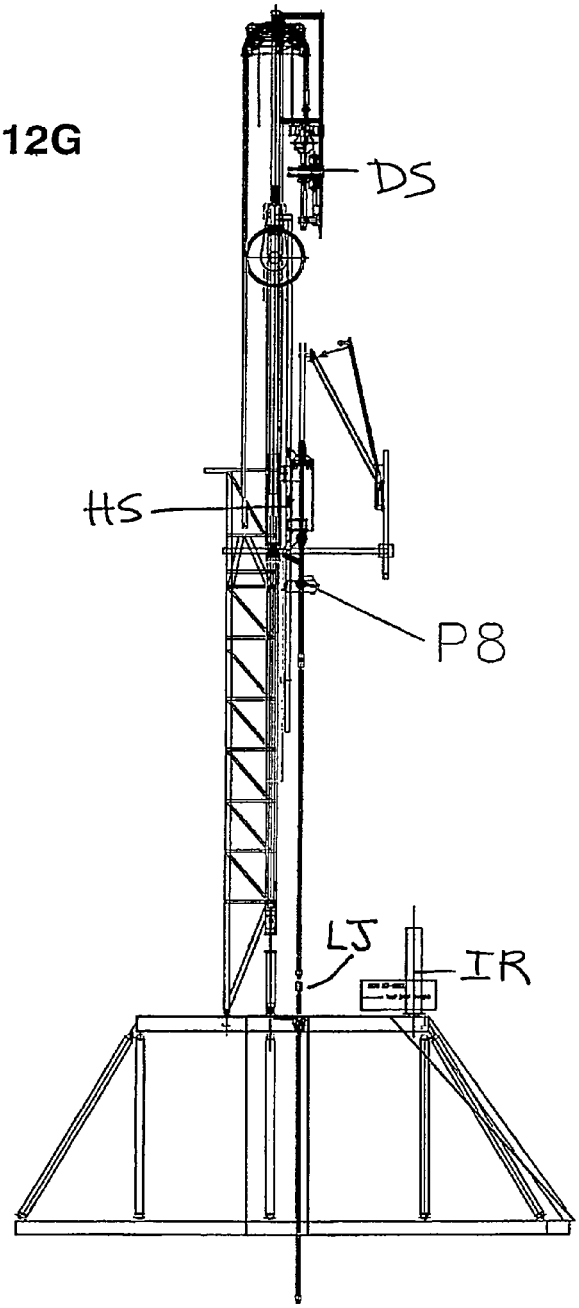

FIG. 12G is a side view showing a step in a method using the system of FIG. 12A.

Figure 12H:
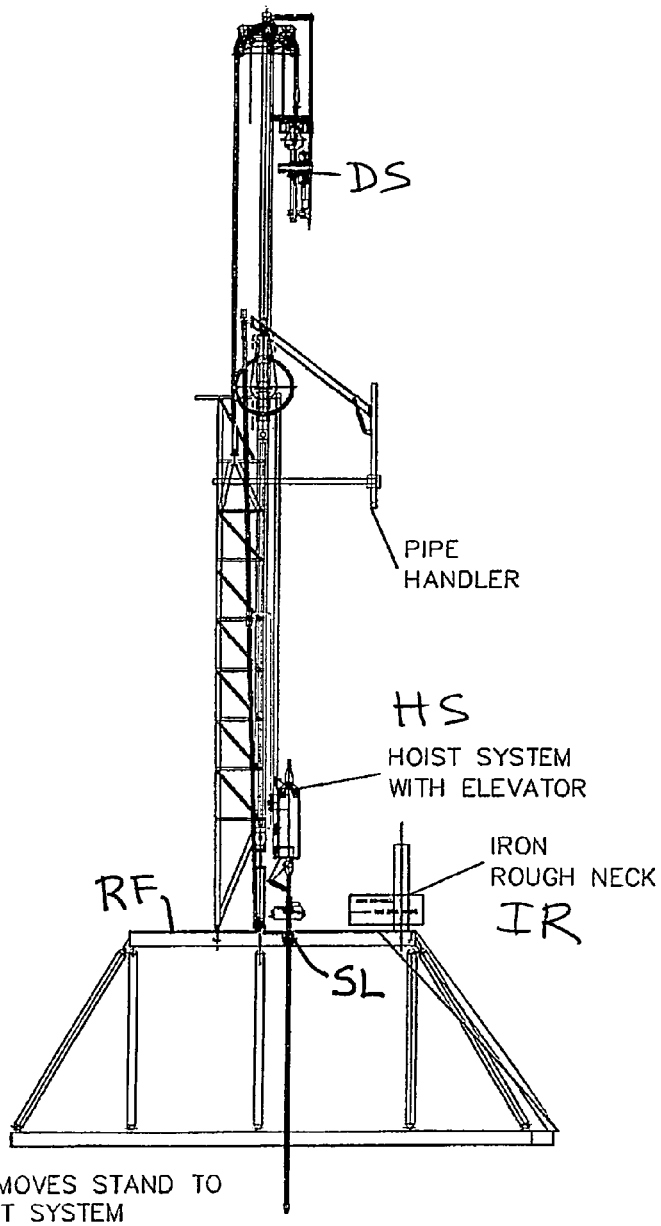

FIG. 12H is a side schematic view showing a step in a method using the system of FIG. 12A.

Certain embodiments of the invention are shown in the above-identified figures and described in detail below. Various aspects and features of embodiments of the invention are described below. Any combination of aspects and/or features described below can be used except where such aspects and/or features are mutually exclusive.

It should be understood that the appended drawings and description herein are of certain embodiments and are not intended to limit the invention. On the contrary, the intention is to cover all modifications, equivalents and alternatives falling within the spirit and scope of the invention as defined by the appended claims. In showing and describing these embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular embodiment. Accordingly, the subject or topic of each such reference is not automatically or necessarily part of, or required by, any particular embodiment. So long as they are not mutually exclusive or contradictory any aspect or feature or combination of aspects or features of any embodiment disclosed herein may be used in any other embodiment disclosed herein. The present invention includes a variety of aspects, which may be combined in different ways. The following descriptions are provided to list elements and describe some of the embodiments of the present invention, including those preferred at the time of filing for this patent. These elements are listed with initial embodiments, however it should be understood that they may be combined in any manner and in any number to create additional embodiments. The variously described examples and preferred embodiments should not be construed to limit the present invention to only the explicitly described systems, techniques, methods and applications.

Further, this description should further be understood to support and encompass descriptions and claims of all the various embodiments, systems, techniques, methods, devices, and applications with any number of the disclosed elements, with each element alone, and also with any and all various possible permutations and combinations of all elements in this or any subsequent application.

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments.

Various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, items or elements in the invention may be shown schematically in order not to obscure the embodiments in unnecessary detail. In other instances, well-known structures and techniques may be shown without unnecessary detail in order to avoid obscuring the embodiments.

Although a process may be described with steps and/or operations as happening sequentially, many of the steps and/or operations can be performed in parallel or concurrently. In addition, the order of the operations may be re-arranged.

A process may be terminated when its operations are completed, but could have additional steps not discussed or included in a figure. Furthermore, not all operations in any particularly described process may occur in all embodiments.

Embodiments of the invention may be implemented, at least in part, either manually or automatically. Manual or automatic implementations may be executed, or at least assisted, through the use of machines, computers, hardware, software, firmware, middleware, microcode, hardware description languages, or any combination thereof.

DETAILED DESCRIPTION OF THE INVENTION

Referring now to FIG. 1, a system 10 according to the present invention is in a drilling rig 11 which is depicted schematically as a land rig, but other rigs (e.g., offshore rigs, jack-up rigs, semisubmersibles, drill ships, and the like) are within the scope of the present invention.

In conjunction with an operator interface, e.g. an interface 11*i*, a control system 11*c* (on site and/or remotely) controls operations of the system 10 and of the rig. The rig 11 includes a derrick 11*r* that is supported on the ground above a rig floor 11*f*. The rig 11 includes apparatus 12 mounted to derrick 11*r* which facilitates movement of a drive subsystem 10*d* and a hoist subsystem 10*h*.

Cables 14*a*, 14*b* (for drive subsystem 10*d*) and cables 14*c*, 14*d* (for hoist subsystem 10*h*) are reeled in and out from a drawworks 14.

The drive subsystem 10*d* may include any suitable known top drive used in wellbore operations with one motor or with multiple motors. In certain aspects, a top drive is used which has frequency drive controller, a motor (or motors) and a drive shaft which is connectible to a tubular (e.g., but not limited to, pipe or drill pipe). Optionally, a known rotary drive system RD at rig floor level (shown schematically in dotted line) is used with or instead of the drive subsystem 10*d*.

A docking structure 11*d* has selectively engageable locking apparatuses 11*a* (shown schematically) for selectively securing the drive subsystem 10*d* in the top of the derrick 11*r*.

It is within the scope of the present invention to selectively secure a drive subsystem at any desired location within a derrick, with the drive subsystem connected to or disconnected from a hoist subsystem. For example, locking apparatuses 11*x* may be used to releasably secure a drive subsystem at any location in a derrick; e.g., near the bottom, near a rig floor, or (as shown with the apparatuses 11*x*) at or near a midpoint of the derrick. Also, apparatuses like the apparatuses 11*x* may be used to secure a hoist subsystem at a desired location in a derrick.

The drive system 10*d* rotates a drill string 16 (or a tubular or tubular, not shown) to which the drive shaft (not shown) is connected. In one particular aspect, the drill string 16 is coupled to the drive subsystem 10*d* through an instrumented sub (not shown) which includes sensors that provide information, e.g., drill string torque information.

The drill string 16 may be any typical drill string and, in one aspect, includes a plurality of interconnected sections of drill pipe 16*d* and a bottom hole assembly ("BHA") 16*h* (shown schematically), which can include stabilizer(s), drill collar(s), and/or instruments, e.g., measurement while drilling (MWD) instrument(s) including a steering tool, to provide drilling information, e.g., but not limited to, bit face angle information. Optionally a bent sub (not shown) is used with a downhole or mud motor and a drillbit 16*b*, connected to the BHA 16*h*.

Drilling fluid is delivered to the drillstring 16 by mud pumps 16*m* through a mud hose 16*h*. During rotary drilling, drillstring 16 is rotated within the wellbore 17 by the drive subsystem 10*d* (and/or by the rotary drive system RD).

It is within the scope of the present invention to react torque from the drive subsystem to the derrick 11*r* using any suitable known apparatus and/or structure. In one aspect, the drive subsystem is slidingly mounted on parallel vertically extending rails on the derrick 11*r* (not shown) to resist rotation as torque is applied to the drill string 16.

Drill cuttings produced as the bit 16*b* drills into earth E are carried out of wellbore 17 by drilling mud supplied by the mud pumps 16*m*.

FIG. 1A shows the drive subsystem 10*d* separated from the hoist subsystem 10*h*.

The hoist subsystem 10*h* includes elevator apparatus 10*e* suspended from a main body 10*b*. The hoist subsystem 10*h* is separable as desired from the drive subsystem 10*d* and is usable to pick up tubulars and to position them, e.g., for make up or break out of joints and in tripping operations. The drive subsystem 10*d* can be raised above the hoist subsystem 10*h* and parked at the top of the derrick 11*r* during such operations with tubulars.

FIGS. 2A and 2B show a system 20 according to the present invention which has a drive subsystem 21 releasably connected to a frame 23 of a hoist subsystem 22 with connection assemblies 24. Lugs 27 on top of the drive subsystem 21 provide structures to which support cables (not shown) are connected to the drive subsystem 21. The drive subsystem 21 may include any suitable top drive system 29 (or top drives).

The hoist subsystem 22 has lugs 26 through which pass part 24*a* of the connection assemblies 24. The parts 24*a* extend through the . lugs 26 and into the drive subsystem 21 for releasably securing the drive subsystem 21 to the frame 23.

Links 25 suspend an elevator 28 from the frame 23. The links 25 may be used to move the elevator away from a center line of the apparatus (see FIG. 2A) and they may be used to support a drill pipe DP (or a drill string) (see FIG. 2B). The top drive(s) 29 of the drive subsystem 21 can rotate drill pipe DP.

FIG. 2C shows the drive subsystem 21 apart from the hoist subsystem 22.

FIGS. 3A and 3B show a system 30 according to the present invention and FIGS. 3C-3E show various steps in an operation of the system 30.

The system 30 has a drive subsystem 31 and a hoist subsystem 32 which are movable with respect to a mast 33 (e.g., but not limited to, a mast or derrick of known land and offshore rigs). Locking assemblies 34*a* releasably secure the drive subsystem 31 to a frame 34. The locking assemblies 34*a* have movable extensions 34*e* which pass through bars 34*f* of the frame 34 and into the drive subsystem 31 to lock the drive subsystem to the frame 34.

The drive subsystem 31 includes a top drive 39 which may be any suitable known top drive used in wellbore operations with any suitable motor or motors and associated structures, connections, conduits, loops, apparatuses, and/or power sources, including, but not limited to, those referred to herein and in patents or patent applications as cited herein (as may be true for the drive subsystem of any embodiment hereof).

Lines 31*n* support the drive subsystem 31 and lines 32*n* support the hoist subsystem 32. These lines can be reeled in and out from a typical drawworks, not shown, or any suitable powered apparatus (e.g., but not limited to, hydraulic cylinder apparatuses according to the present invention as described herein) may be used to move the lines to lower and raise their respective attached structures. The lines 31*n* are releasably connected with connectors 31*c* to lugs 31*g* on the drive subsystem 31. The lines 32*n* are connected to the frame 34 with connectors 34*c* releasably connected to upstanding parts 34*s* of the frame 34. The lines 32 *n* pass over sheaves 32*h* connected to the top beam 34*b*; and the lines 31*n* pass over sheaves 31*h* on the beam 35.

Drive subsystem 31 has a support beam 35 which rides on, but is not secured to, a top beam 34*b* of a frame 34 of the hoist subsystem 32. The support beam 35 can be releasably locked in position near a top of the mast 33 with locking assemblies 33*a*; for example, when the drive subsystem is disconnected from the hoist subsystem 32, with the support beam 35 locked to the mast 33, the drive subsystem 31 is held in position at the top of the mast 33.

Cylinder apparatuses 36 either within parts of the mast 33 (see, e.g., FIG. 3E) or located outside the mast 33 (see dotted lines in FIG. 3C), have parts, e.g. powered pistons, which extend and retract to move the top beam 34*b* thereby moving the hoist subsystem 32 up and down with respect to the mast 33. The lines 31*n* may be used to raise and lower the drive subsystem 31 with respect to the beam 35; and the lines 32*n* may be used to raise and lower the hoist subsystem 32 with respect to the top beam 34*b* of the hoist subsystem.

Links 38*a* connected to lower lugs 34*w* of the frame 34 support an elevator 38 (which is shown in FIGS. 3B and 3C supporting drill pipe DR).

As shown in FIG. 3C, the combined drive-subsystem-31/hoist-subsystem-32 system 30 has been moved to the top of the mast 33 (by expanding the cylinder apparatuses 36). Parts 33*s* of the locking assemblies 33*a* are extended through holes 35*t* in upright bars 35*a* of the support beam 35 and into corresponding holes 33*t* of the mast 33 to releasably lock the drive subsystem at the top of the mast 33.

As shown in FIGS. 3D and 3E, after the locking assemblies 34*a* are unlocked, freeing the drive subsystem 31 from the frame 34 of the hoist subsystem 32, the hoist subsystem 32 is lowered with respect to the mast 33 and beneath and with respect to the drive subsystem 31; e.g., for tripping drill pipe or other operations. For example, the hoist frame 34 is lowered to a point above a joint of drill pipe that is in slips (not shown) on a rig and a tripping operation commences while the drive subsystem is docked at the top of the mast 33.

FIG. 4 illustrates schematically a system 40 according to the present invention which has a drive subsystem 41 releasably connected to a frame 45 of a hoist subsystem 42 with connectors 43. The drive subsystem 41 may be disconnected from the hoist subsystem for any operation using the hoist subsystem or part of it.

Lines 44 (like the lines in FIGS. 1 and 3B) connected to connectors 45*a* support a frame 45 of the hoist subsystem 42 and provide for its raising and lowering (by suitable apparatus, not shown).

The drive subsystem 41 includes any suitable top drive system 49 which is movable (for raising or lowering) by lines 49*n*. The drive subsystem 41 has a drive shaft 41*d* and any suitable sub(s) 41*s*.

Suspended below and/or connected to the frame 45 with connection structure 45*t* or 45*s* are any known apparatuses 46*a* and/or 46*b* used with top drives and/or used in wellbore operations; e.g., but not limited to, elevators, clamping apparatuses, and pipe grabbers.

FIG. 4A shows a drive subsystem DS according to the present invention which has releasable locking apparatuses RL thereon for selectively securing the drive subsystem DS at any desired location within a derrick, rig, or mast. The apparatuses RL may be any suitable known releasable locking apparatuses or devices; or they may be like any such apparatuses disclosed herein.

FIG. 4B shows a hoist subsystem HS according to the present invention which has releasable locking apparatuses RA thereon for selectively securing the hoist subsystem HS at any desired location within a derrick, rig, or mast. The apparatuses RA may be any suitable known releasable locking apparatuses or devices; or they may be like any such apparatuses disclosed herein.

FIG. 5A shows a system 50 according to the present invention which includes a hoist system 60 and a drive system 70. The drive system 70 is releasably connected to the hoist system 60.

As shown in FIGS. 5A, 5B, and 6, the hoist system 60 has a yoke assembly 61 with a top beam 61*a*, side beams 61*s*, and a bottom beam 61*b*. Links 62*a* connected to lugs 62*b* on the bottom beam 61*b* support an elevator 62. The links 62*a* are rotatable within the lugs 62*b* to move the elevator 62 by rotating cylinder assemblies 62*r* which are connected between the links 62*a* and the bottom beam 62*b*.

Four releasable locking cylinder assemblies 63 selectively secure the drive system 70 to the yoke assembly 61. Parts 63*e* of the assemblies 63 are movable in and out to achieve this locking. Motion limiting plates 63*p* and supports 63*r* and 63*s* assist in maintaining the drive system 70 in place on the yoke assembly 60. Four rollers 64 (three shown) roll in tracks (not shown) to facilitate movement of the hoist system 60 on a derrick, rig, or mast.

Wire lines (not shown) are connected to spelters 65*a* which are connected to lugs 65*b*. The lugs 65*b* are rotatably connected to connectors 65*c* which project from bars 65*d* connected to the side beams 61*s*. These wire lines function, e.g., like the lines 32*n*, FIG. 3B.

As shown in FIGS. 5A, 5C, and 7, the drive system 70 includes motors 71 which drive a gear system (not shown) in a gear box 71*b* which drive a drive shaft 71*d* connected to a saver sub 71*s*. Structural tubes 72 connected to the gear box 71*b* support an upper frame 73. A grabber support tube 74*t* supports a grabber 74. The grabber 74 includes a tube 74*s* that telescopes in and out with respect to the support tube 74*t* for raising and lowering of the grabber 74. Apparatus 74*x* actuates the grabber 74. Optionally, a pipe wrench (not shown) is positioned below and/or connected to the top drive; e.g., a double jaw pipe wrench with hydraulically powered jaws for making up and for breaking out joints. Drilling mud flows through a mud swivel 79.

Parts 63*e* of the hoist system's yoke assembly 61 are releasably extendable into chambers 73*c* of the upper frame 73 to selectively secure the drive system 70 to the yoke assembly 61.

Optional tubes 75 receive corresponding tubes, members, or shafts (not shown; see, e.g., projecting members 86*c*, FIG. 8H)) connected to a mast, rig, or derrick to insure proper positioning of the drive system 70 and, in certain aspects, to maintain the drive system 70 in alignment with a center line of a wellbore (when a rotary drive assembly is docked).

Lines (not shown; like, e.g., the lines 31*n*, FIG. 3B) can be connected to the lugs 76 on top of the frame 73.

The frame 73 reacts torque from the drive system 70 into the rollers 64 and from the rollers 64 to the tracks of the derrick and into the derrick.

A swivel system 77 with the mud swivel 79 (any suitable known swivel for a top drive system) provides drilling fluid (mud) to the tubular(s) beneath the drive system 70, e.g., to drill pipe in a drilling operation and supports a drill string.

FIG. 8A shows a system 80 according to the present invention which includes a drive system 81 for rotating tubular and a hoist system 82 for hoisting tubular. The drive system 81 may be releasably connected to the hoist system 82. A mast MS with a crown CN extends up from a rig floor RF. A substructure ST supports the rig floor RF. An iron roughneck IR is on the rig floor.

A stand of pipe SP passes through powered slips in the rig floor into a wellbore WB in the earth. A mud hose MH supplies drilling fluid to the drive system 81. A holding structure 86 positions the drive system 81 with respect to the mast MS when docked.

Various lines, hoses, and conduits—including those which heretofore have been housed and moved in a "service loop" in conventional systems—including the mud hose MH, are positioned by and move over a loop assembly 84 connected to the top of the mast MS.

Lines 87 secured to the mast MS support the drive system 81 in the position shown. A top beam 81*a* of the drive system 81 is releasably secured to the mast MS with apparatuses 81*k* (see FIG. 8C). A frame 81*b* of the drive system 81 can move with the hoist system 82 (although these two beams are shown apart in FIG. 8A) and rests on a beam 82*d* (see FIG. 8C) of the hoist system 82 during such movement.

_An assembly 89 that facilitates raising and lowering of the hoist system 82 in the mast MS has a top beam 89*a* and wireline sheave support plates 89*b* of sheaves 89 on which lines 85 move. The lines 85 loop over the sheaves 89 supporting the hoist system 82. The lines 85 connect to clevis assemblies 89*c* pinned to upright portions 82*e* of the hoist system 82. The lines 85 support the hoist system 82 below the top beam 89*a*.

Cylinder assemblies 88 connected to the beam 89*a* raise and lower the sheaves 89 and thereby raise and lower the hoist system 82. Optionally, a drawworks (not shown; e.g., like the drawworks 14, FIG. 1) reels lines in and out for the raising and lowering of various apparatuses and component. It is within the scope of the present invention to use one, two, three, four or more assemblies 88.

Any suitable releasable locking mechanisms or devices may be used for the apparatuses 81*k* and 82*k*. In one aspect, the apparatuses 81*k* are hydraulic or air cylinder apparatuses which lock the top beam 81*a* in place after the hoist system 82 has raised the top beam 81*a* in place at the top of the mast MS. In one aspect, as shown in FIGS. 8C-8F, the top beam 81*a* has an upright lock plate 81*m* with a hole 81*s* and the top beam 89*a* has an upright plate 89*m* with a hole 89*s*.

A pin 81*p* extends through both holes (and is selectively removable therefrom). The pin 81*p* has a groove 81*t* in which an end 89*x* with a cutout 89*y* of a floating lock plate 89*p* is received to hold the pin 81*p* and prevent its horizontal movement until the floating lock plate 89*p* is removed.

When the hoist system 82 has lifted the beam 81*a* to the top of the mast, the plate 89*m* on the beam 89*a* lifts up the floating lock plate 89*p*. This allows the pin 81*p* to pass through the plate 89*p*. After the pin 81*p* has been pushed into place, the hoist system 82 is lowered and the lock plate 89*p* is lowered into position. The cutout 89*y* of the lock plate 89*p* mates with the groove 81*t* of the pin 81*p*. Then, if the cylinder apparatus 81*k* is inadvertently actuated to retract the pin 81*p*, the pin 91*p* is held in place and cannot retract because the end of the pin 91*p* cannot go through the lock plate 89*p*.

The holding structure 86 (FIG. 8B) has an upper part that telescopes with respect to a lower part. The upper part has projecting members which are receivable in corresponding receptacles of a support structure or frame of a drive system (e.g., in tubes 75, FIG. 7). The structure 86 maintains the position of a drive system.

The present invention, in certain aspects, provides a loop system for the disposition, handling, and guiding of various service loops, including loops, cables, conduits, and hoses associated with a drive system and/or a hoist system according to the present invention. In such loop systems according to the present invention, service loops (e.g., air, hydraulic fluid, drilling mud, electrical cables, etc.) connected to a drive system and hoist system travel up to a crown block area of a mast and wrap around rollers from which they descend to connections in the mast or at the drill floor, e.g., on a side opening of a drive system and/or hoist system.

With such a loop system according to the present invention, there is no need for the known typical service loop system, e.g., that on the v-door side of a rig that travels up and down in the rig and down to a rig floor area which can hinder operations.

In loop systems according to the present invention, the rollers keep each loop separate in an orderly fashion without the need for a drag chain as in many known service loop systems which carry the various loops.

FIG. 8G shows a loop assembly 84 according to the present invention which has a base 84*a* to which are connected three roller assemblies 84*b* each with a plurality of rollers 84*c* and two roller assemblies 84*d* with dual spaced-apart rollers 84*e*. It is within the scope of the present invention for there to be any desired number of roller assemblies 84 and/or 84*d*; e.g., sufficient roller assemblies to accommodate any desired number of hoses, conduits, and loops. It is also to be understood that it is within the scope of the present invention for the rollers (or some of them) to be deleted and to use a shaped surface or surfaces which do not rotate to facilitate movement of hoses, etc. with respect to and over the loop assembly.

FIG. 8J shows the loop assembly 84 with the rollers removed.

A loop system according to the present invention, e.g., as shown in FIGS. 8G and 8H, has separate loops and rollers that travel on separate movable beams to run loops to both a hoist system and to a drive system separately. This allows parking of a drive system in a rig, while allowing a hoist system to move with respect to the drive system.

As shown in FIGS. 8I and 8J, an embodiment of a loop system LS according to the present invention (e.g., using loop assemblies as in FIGS. 8G, 8H) has hoist system service loops and rollers, and a beam supporting these rollers. This beam is powered by the main hoist cylinders that move the hoist system. The loop system LS also supports the drive system service loops and rollers.

FIGS. 8A and 8K-8P illustrate use of the system 80 in a tripping operation. As shown in FIG. 8A, the drive system 81 is docked and secured in place at the top of the mast MS and the locking apparatuses 81*k* are locking the top beam 81*a* to the mast MS. The hoist system 82, disconnected from the drive system 81, is lowered and is connected to the stand SP that is in the slips SL (i.e., an elevator EV of the hoist system 82 is connected to the stand SP). The hoist system 82 is lowered by scoping in the cylinder assemblies 88. In one particular aspect, these cylinder assemblies 88 have a stroke length of about nine hundred and sixty inches.

As shown in FIGS. 8K and 8L, the hoist system 82 is used to pull the stand SP out of the wellbore WB and the slips SL are set on the pipe at the rig floor RF. The hoist system is raised (using the powered cylinders 88).

The hoist system is then lowered as shown in FIG. 8M and it passes the pipe handler PH. The pipe handler PH is positioned at the top of the stand SP and the stand is then spun out using the iron roughneck IR. Such operation results in time saving (as compared to certain prior systems and methods). After the stand of pipe has been hoisted up, after the slips are set, the hoist system 82 can be started down toward the drill floor. The pipe handler PH is positioned close to the centerline of the hole and can quickly move over and latch onto the stand of pipe SP. As soon as the iron roughneck IR breaks out the lower joint of drill pipe, the pipe handler PH can move the stand from the centerline of the hole and rack it in the racking board RB. Simultaneous movement of the hoist system 82, the pipe handler PH, and the iron roughneck IR saves time.

As shown in FIGS. 8N and 8O, the elevator EV is released from the pipe and the hoist system 82 is lowered. The pipe handler PH is raised and the stand is raised above the pipe in the slips SL. The pipe handler PH then racks the stand in the racking board RB.

While the pipe handler PH is moving the stand SP to the racking board RB (see FIG. 8P), the hoist system 82 is moved down to the rig floor RF and the elevator EV is attached to the pipe PP in the slips SL. The method is then repeated to remove and rack another stand.

FIGS. 9A-9H illustrate a drilling operation with the system 80. Using the drive system 81, drilling has been done down to the lower limit of the stroke of the cylinder assemblies 88 as shown in FIG. 9A. The elevator EV has been moved out of the way; a pipe grabber GB has been moved up; and the slips SL are set on drill pipe DP. The top beam 81*a*, which supports the loop assembly 84, rests on and rides on the beam 89*a* during drilling. Personnel use a driller control system DC.

As shown in FIG. 9B, using the hoist system 82, the drill string DG with the drill pipe DP is raised by scoping out the cylinder apparatuses 88 and the slips SL are set.

A grabber GR of the drive system 81, as shown in FIG. 9C, is actuated and clamps onto the drill pipe. The saver sub is then spun out from the drill string DG using the motors of the drive system 81.

With the drive system 81 released from the drill string DG, as shown in FIG. 9E, the hoist system 82 pickups a new joint of drill pipe DE using the elevator EV.

As shown in FIG. 9F, the joint DE is lifted up by the hoist system 82 (the cylinder apparatuses 88 are scoped out). The iron roughneck IR is then positioned over the wellbore and the joint DE is lowered using the hoist system 82 (by scoping in the cylinders 88) for connection to the drill string DG.

The joint DE is lowered to the drill string DG. The saver sub is lowered into the joint by lowering the hoist system. With the iron roughneck IR holding the drill string DG, the drive system 81 makes up the new joint, spinning the joint DE into the drill string DG using the saver sub. The iron roughneck is then used to make up the lower joint, rotating the upper threads into the lower threads to a recommended torque. The drive system and the grabber make up the upper joint.

As shown in FIG. 9H, the iron roughneck is released and the elevator EV is released and moved out of the way. The slips SL are released and drilling with the drive system 81 commences.

In certain aspects of the present invention, conventional service are deleted and a loop assembly according to the present invention, e.g., like the loop assembly 84 described above, is used. FIGS. 10A and 10B show a rig according to the present invention in drilling mode. A drive system 81 (as described above) and a hoist system 82 (as described above) are pinned together. The service loops for these systems are routed around rollers mounted at the top of the travelling structures. There are no loose, unguided hoses in the mast MS.

As shown in FIG. 10B, there are: a mud hose MH and mud hose rollers MRH; drive system service loops DSSL and drive system service loop rollers TDSLR; and hoist system service loops HSSL and hoist system service loop rollers HSSLR.

FIG. 8M shows a rig in tripping mode. The drive system 81 has been hoisted up to the top of the mast MS by the cylinder apparatuses 88 and lines 85, then pinned to the top of the mast MS with the cylinder assemblies 81*k* and the pin 81*p*. The mud hose MH and the top drive service loops are not moving during this tripping operation, unlike in many typical top drive rigs. Thus, bending cycles on these loops are reduced, prolonging loop life and rendering the operations more efficient.

A hoist system 82*a* shown in FIG. 11 (like the hoist system 82) has a wire line socket WLSC; an hydraulic cylinder HC (or cylinders); and a moving wire line WL. It is an advantage of this system that the wire line WL moves relatively slow compared to those of certain prior systems, since it goes over only one sheave WS, resulting in less bending cycles of the wire line WL. (The line WL correspond to the line 32*n*, FIG. 3E; the socket WLSC corresponds to connector 31*c*).

It is an advantage of this system that the hydraulic cylinder (s) HC have relatively few moving parts (in one aspect, only three moving parts and, unlike some prior systems which use a drawworks, heat generated by braking during drilling or tripping is absorbed by the hydraulic fluid and easily cooled. No brake pads, brake rims, and other brake parts are worn out using the cylinder(s) HC and there is an hydraulic system which has no rubbing parts that are not lubricated with the hydraulic fluid of the cylinders.

A pipe handling system 120 according to the present invention is shown in FIGS. 12A-12H. In certain aspects, the pipe handling system 120 is used as the pipe handler PH in the system 80 (e.g., see FIGS. 8A-9H). The pipe handling system 120 has a racking board P1; a first handler travelling assembly P2 for movement in the direction indicated as X-X, FIG. 12B; a second handler travelling assembly P3, for movement in the direction indicated as Z-Z, FIG. 12A; and a handler parallel arm travelling assembly P4 for movement in the direction indicated as Y-Y, FIG. 12A.

The pipe handling system 120 also has a handler transfer elevator assembly P5; transfer elevator keeper assemblies P6; a powered elevator P8; and a transfer elevator ejector device P9. As an example, the system 120 is shown handling a stand of drill pipe P7.

The method illustrated in FIGS. 12A-12H uses a hoist system HS according to the present invention (e.g., like the hoist system 82 described above); a drive system DS according to the present invention (e.g., like the drive system 81 described above); and an iron roughneck IR.

In a method according to the present invention as shown in FIG. 12A, the drive system DS has been docked at the crown CN and locked in place. The hoist system HS is lowered around the stand P7 which is in the slips SL. As shown in FIG. 12C, the stand P7 is raised by the hoist system HS and the slips SL are set.

The hoist system is then lowered (FIG. 12D) and when it passes the transfer elevator P5, the pipe handling system 120 is positioned at the top of the stand P7. The iron roughneck IR then backs out and spins out the stand P7.

As shown in FIG. 12G, the powered elevator P8 is released from the stand P7 while the hoist system HS is lowered. The pipe handling system 120 is then raised with the stand P7 clear of the lower tool joint LJ. The pipe handling system 120 then racks the stand P7 in the racking board P1.

While the pipe handling system 120 moves the stand P7 to the racking board P1, (see FIG. 12H), the hoist system HS with the elevator P8 moves down to the rig floor RF and the elevator P8 attaches to the pipe in the slips SL. While the stand P7 is being racked, the hoist system HS begins to hoist the next stand; i.e., the hoist system HS is moving with a new stand simultaneously as the pipe racking system 120 racks the stand P7, while the iron roughneck IR is also moving (back from well centerline).

As can be easily understood from the foregoing, the basic concepts of the present invention may be embodied in a variety of ways. It involves both structures, method steps, and techniques as well as devices to accomplish the appropriate ends. Techniques and method steps according to the present invention are disclosed as part of the results shown to be achieved by the various devices and structures and described and as steps which are inherent to utilization and are simply the natural result of utilizing the devices and structures as intended and described. In addition, while some devices and structures are disclosed, it should be understood that these not only accomplish certain methods but also can be varied in a number of ways. Importantly, as to all of the foregoing, all of these facets should be understood to be encompassed by this disclosure.

The discussion herein is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure.

Where the invention is described in device-oriented or apparatus-oriented terminology, each element of the device or apparatus implicitly performs a function. Apparatus claims may not only be included for the device or apparatus described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application.

It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action.

Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "support" should be understood to encompass disclosure of the act of "supporting"—whether explicitly discussed or not—and, conversely, were there effectively disclosure of the act of "supporting", such a disclosure should be understood to encompass disclosure of a "support". Such changes and alternative terms are to be understood to be explicitly included in the description.

Any acts of law, statutes, regulations, or rules mentioned in this application for patent; or patents, publications, or other references mentioned in this application for patent are hereby incorporated fully and for all purposes by reference. In addition, as to each term used it should be understood that unless its utilization in this application is inconsistent with such interpretation, common dictionary definitions should be understood as incorporated for each term and all definitions, alternative terms, and synonyms are hereby incorporated by reference.

Thus, the applicants for this patent should be understood to have support to claim and make a statement of invention to at least: i) each of the pump systems and new parts thereof as herein disclosed and described, ii) the related methods disclosed and described, iii) similar, equivalent, and even implicit variations of each of these systems, parts, and methods, iv) those alternative designs which accomplish each of the functions shown as are disclosed and described, v) those alternative designs and methods which accomplish each of the functions shown as are implicit to accomplish that which is disclosed and described, vi) each aspect, feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the inventors may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available.

To the extent that insubstantial substitutes are made, to the extent that the applicant did not in fact draft any claim so as to literally encompass any particular embodiment, and to the extent otherwise applicable, the applicant should not be understood to have in any way intended to or actually waived or relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Any claims set forth at any time during the pendency of the application for this patent or offspring of it are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

In conclusion, therefore, it is seen that the present invention and the embodiments disclosed herein and those covered by the appended claims are well adapted to carry out the objectives and obtain the ends set forth.

Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. It is intended to cover the invention as broadly as legally possible in whatever form it may be utilized. The invention described herein is new and novel in accordance with 35 U.S.C. §102 and satisfies the conditions for patentability in §102. The invention described herein is not obvious in accordance with 35 U.S.C. §103 and satisfies the conditions for patentability in §103.

The inventor may rely on the Doctrine of Equivalents to determine and assess the scope of the invention. All patents and applications identified herein are incorporated fully herein for all purposes. The word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

What is claimed is:

1. A system for wellbore operations for a well with a wellbore support structure, the system comprising:

a hoist subsystem for moving tubulars;

a drive subsystem for rotating the tubulars;

the drive subsystem releasably connected to the hoist subsystem forming a hoist and drive unit;

powered apparatus for moving the hoist and drive unit;

the drive subsystem disconnectable from the hoist subsystem; and the hoist subsystem, separable from the drive subsystem, for movement by the powered apparatus within the wellbore support structure.

2. The system of claim 1 wherein the powered apparatus comprises powered cylinder apparatus.

3. The system of claim 2 further comprising a mast;

the hoist subsystem and the drive subsystem within the mast, and the powered cylinder apparatus adjacent the mast.

4. The system of claim 2 further comprising a mast, the mast having hollow parts, the powered cylinder apparatus within hollow parts of the mast.

5. The system of claim 1 further comprising the drive subsystem movable within the wellbore support structure apart from the hoist subsystem.

6. The system of claim 1 further comprising a loop system for handling a plurality of service loops, the loop system comprising a body, a plurality of rollers rotatably connected to the body, at least one roller for the each loop of the plurality of service loops, and the rollers facilitating movement of each loop and maintaining the loops in desired spaced-apart relation.

7. The system of claim 6 wherein the loops are one of cables, conduits, and hoses used in the wellbore operations.

8. The system of claim 7 wherein the wellbore operations include an operation using the drive system and an operation using the hoist system.

9. The system of claim 7 wherein the well operation is one of an operation using both the drive system and the hoist system.

10. The system of claim 6 wherein the loop system is operable for a well operation without using a drag chain.

11. The system of claim 6 wherein each of the plurality of loops transmit one of air, hydraulic fluid, drilling mud, fracturing fluid, and electrical current.

12. The system of claim 1 further comprising a handling system comprising a pipe handling apparatus for moving a first stand of pipe to a racking board, a pipe racking apparatus for racking the first stand, the hoist system including an elevator movable down to a rig floor to attach to a pipe in slips, and the hoist system able to begin to hoist a second stand simultaneously as the pipe racking apparatus racks the first stand.

* * * * *